US011641906B2

(12) United States Patent
Farris et al.

(10) Patent No.: US 11,641,906 B2
(45) Date of Patent: May 9, 2023

(54) MEDIALLY-LOCATED LATERAL FOOTWEAR STABILIZER

(71) Applicant: NIKE, Inc., Beaverton, OR (US)

(72) Inventors: Bryan N. Farris, North Plains, OR (US); Bruce Alan Barney, Portland, OR (US); Rachel M. Savage, Beaverton, OR (US); Alison Sheets-Singer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 198 days.

(21) Appl. No.: 17/177,403

(22) Filed: Feb. 17, 2021

(65) Prior Publication Data

US 2021/0267304 A1 Sep. 2, 2021

Related U.S. Application Data

(60) Provisional application No. 62/982,403, filed on Feb. 27, 2020.

(51) Int. Cl.
*A43B 7/24* (2006.01)
*A43B 7/1425* (2022.01)
*A43B 13/02* (2022.01)

(52) U.S. Cl.
CPC ..... *A43B 7/24* (2013.01); *A43B 7/1425* (2013.01); *A43B 13/026* (2013.01)

(58) Field of Classification Search
CPC ..... A43B 7/24; A43B 7/1425; A43B 7/1415; A43B 13/026
USPC ..... 36/142–144, 31, 73, 75 R
See application file for complete search history.

(56) References Cited

U.S. PATENT DOCUMENTS 1,701,611 A * 2/1929 Glidden ..... A43B 13/12 36/73
2,008,985 A 7/1935 Lattemann
2,185,995 A * 1/1940 Haskell ..... A43B 13/383 36/43
2,190,568 A 2/1940 Lattemann
4,063,562 A 12/1977 Smith
4,506,460 A * 3/1985 Rudy ..... A43B 13/206 36/38
4,615,126 A 10/1986 Mathews
4,624,061 A 11/1986 Wezel et al.
(Continued)

FOREIGN PATENT DOCUMENTS

WO 9211780 A1 7/1992
WO 2007069069 A2 6/2007

OTHER PUBLICATIONS

"What is WaveSpring® Technology?," Spira, spira.com, Apr. 4, 2014. https://web.archive.org/web/20140404043648/http://spira.com/xlt-running-shoes/.

*Primary Examiner* — Marie D Bays
(74) *Attorney, Agent, or Firm* — Banner & Witcoff, Ltd.

(57) ABSTRACT

A sole structure for an article of footwear. The sole structure includes at least one support plate located on an underside of a midsole on a medial forefoot side of the midsole and extending from a medial edge of the midsole to at least a longitudinal center line of the midsole, wherein a lateral edge of the plate is located medially of the lateral edge of the midsole. The support plate may contain at least one sipe or groove extending laterally across the midsole to provide flexibility in a forefoot-to-heel direction of the midsole. The support plate may contain at least one rail.

20 Claims, 20 Drawing Sheets

(56) References Cited

U.S. PATENT DOCUMENTS 5,295,314 A * 3/1994 Moumdjian ..... A43B 13/203 36/76 R
5,297,349 A 3/1994 Kilgore
5,625,964 A 5/1997 Lyden et al.
5,720,118 A * 2/1998 Mayer ..... A43B 13/38 36/107
5,915,820 A 6/1999 Kraeuter et al.
6,199,303 B1 * 3/2001 Luthi ..... A43B 7/145 36/31
6,202,326 B1 * 3/2001 Hauglin ..... A43B 13/12 36/117.3
6,266,897 B1 7/2001 Seydel et al.
6,389,713 B1 5/2002 Kita
6,477,791 B2 11/2002 Luthi et al.
6,497,058 B2 * 12/2002 Dietrich ..... A43B 7/24 36/31
7,082,702 B2 * 8/2006 Cretinon ..... A43B 13/141 36/76 R
7,299,567 B2 * 11/2007 Berend ..... A43B 23/087 36/108
7,383,647 B2 6/2008 Chan et al.
D578,285 S 10/2008 Vasyli et al.
7,430,820 B2 10/2008 Andreoli et al.
7,533,476 B2 5/2009 Hay
7,721,467 B2 5/2010 Cheskin et al.
7,908,768 B2 3/2011 Cheskin et al.
7,946,060 B2 5/2011 Rosenbaum
8,112,909 B2 2/2012 Kubo et al.
8,171,656 B2 5/2012 Salminen et al.
8,356,428 B2 1/2013 Auger et al.
8,365,440 B2 * 2/2013 Rivas ..... A43B 7/18 36/107
8,365,444 B2 * 2/2013 Youngs ..... A43B 13/141 36/73
8,407,918 B2 4/2013 Gschwender
8,726,542 B2 5/2014 Kim
8,769,843 B2 7/2014 Cook et al.
8,813,392 B2 8/2014 Maron et al.
8,919,015 B2 12/2014 Holt et al.
8,984,775 B2 * 3/2015 Dombrow ..... A43B 23/0295 36/76 R
9,089,185 B2 7/2015 Nishiwaki et al.
9,456,658 B2 10/2016 Bruce et al.
9,516,916 B2 12/2016 Derrier
9,572,399 B2 2/2017 Morag et al.
9,770,066 B2 9/2017 Grelle et al.
9,775,402 B2 10/2017 Nonogawa et al.
9,788,602 B2 10/2017 Wynn et al.
10,617,172 B2 * 4/2020 Cohen ..... A43B 7/005
11,197,514 B2 * 12/2021 Kohatsu ..... A43B 13/141
2002/0050078 A1 * 5/2002 Dietrich ..... A43B 7/24 36/31
2004/0111920 A1 * 6/2004 Cretinon ..... A43B 13/141 36/30 R
2008/0289220 A1 * 11/2008 Rivas ..... A43B 13/141 36/35 R
2009/0260259 A1 * 10/2009 Berend ..... A43B 7/1435 36/35 B
2009/0307926 A1 12/2009 O'Brien et al.
2011/0088287 A1 * 4/2011 Auger ..... A43B 13/223 36/114
2011/0179675 A1 7/2011 Miller et al.
2016/0021972 A1 * 1/2016 Grelle ..... A43B 7/24 36/140
2016/0029741 A1 2/2016 Foxen
2016/0150854 A1 6/2016 Hockerson et al.
2017/0095030 A1 4/2017 Brandstatter
2017/0119093 A1 5/2017 Grott et al.
2017/0245584 A1 8/2017 Ellis
2017/0251750 A1 * 9/2017 Devoe ..... A43B 7/1495
2017/0325543 A1 11/2017 Iuchi et al.
2017/0354200 A1 12/2017 Orand et al.
2018/0000196 A1 1/2018 Lovell et al.
2018/0042338 A1 2/2018 Orand
2019/0239594 A1 * 8/2019 Bell ..... A43B 7/1425
2020/0093223 A1 * 3/2020 Iuchi ..... A43B 13/181
2020/0100565 A1 * 4/2020 Yoshida ..... A43B 13/026

* cited by examiner

MEDIALLY-LOCATED LATERAL FOOTWEAR STABILIZER

CROSS-REFERENCE TO RELATED APPLICATIONS

This application claims priority to U.S. Provisional Application No. 62/982,403 filed Feb. 27, 2020, which is hereby incorporated by reference in its entirety.

BACKGROUND

Articles of footwear generally include two primary elements, an upper and a sole structure. The upper may be formed from a variety of material elements (e.g., textiles, foam, leather, and synthetic leather) that are stitched or adhesively bonded together to form a void on the interior of the footwear for securely receiving a foot. An ankle opening through the material elements may provide access to the void, thereby facilitating entry and removal of the foot from the void. In addition, a lace or other closure may be utilized to modify the dimensions of the void and secure the foot within the void.

The sole structure may be located adjacent to a lower portion of the upper and may be generally positioned between the foot and the ground. In many articles of footwear, including athletic footwear, the sole structure generally incorporates an insole, a midsole, and an outsole. The insole, which may be located within the void and adjacent to a lower surface of the void, may be a thin compressible member that enhances footwear comfort. The midsole, which may be secured to a lower surface of the upper and extends downward from the upper, may form a middle layer of the sole structure. In addition to attenuating ground reaction forces (i.e., providing cushioning for the foot), the midsole may limit foot motions or impart stability, for example. The outsole, which may be secured to a lower surface of the midsole, may form the ground-contacting portion of the footwear and is usually fashioned from a durable and wear-resistant material that includes texturing to improve traction.

Generally, the midsole is the primary source of cushioning for the article of footwear, and it is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and the upper, located between the midsole and the outsole, embedded within the midsole, or encapsulated by the foamed polymer material of the midsole, for example. Although many midsoles are primarily formed from a foamed polymer material, fluid-filled chambers or other non-foam structures may form a majority of some midsole configurations.

Midsoles tend to optimize support and cushioning comfort for a wearer when walking or running. The forces acting on the midsole during these activities tend to be directed vertically and in a forward and aft direction relative to the article of footwear. Midsoles are designed to return predictable and consistent cushioning comfort and support when encountering these forces.

Side-to-side or "banking" movement, particularly among athletes like football, basketball and tennis players, is common. Usually, it is desirable for athletes to quickly change his or her side-to-side direction when banking. An athlete's performance is negatively affected if the midsole and outsole of a shoe wraps around the foot during aggressive side-to-side movements. This shoe phenomenon is called "tube socking" or "toweling".

SUMMARY

Substantially incompressible support structures, e.g. plates, may be added to sole structures of articles of footwear in order to modify various physical properties of the footwear. For example, a midsole may be formed of a soft polymer foam material, and a plate may be attached to, recessed in, or otherwise located on the underside of the midsole in the forefoot medial region. The plate may be formed of a material that is more rigid and/or less compressible than material forming the midsole.

Other systems, methods, features, and examples will be apparent to one of ordinary skill in the art upon examination of the following figures and detailed description.

BRIEF DESCRIPTION OF THE DRAWINGS

The disclosure may be better understood with reference to the following drawings and description. The components in the figures are not necessarily to scale. Moreover, in the figures, like reference numerals designate corresponding parts throughout the different views.

DETAILED DESCRIPTION

The following discussion and accompanying figures disclose various configurations of sole structures. Concepts associated with the sole structures may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the sole structures may also be utilized with footwear styles that are generally considered to be non-athletic, including dress shoes, loafers, and sandals.

General Footwear Structure

Figure 1:
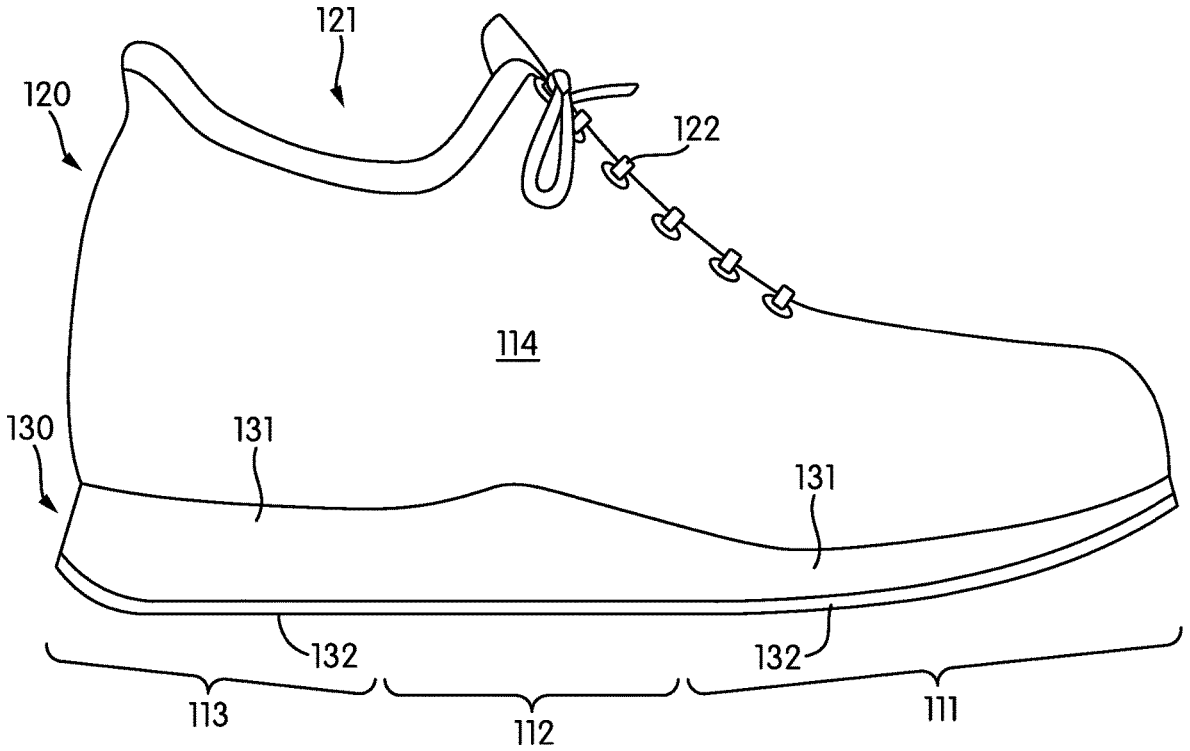
FIG. 1 is a lateral side elevational view of an article of footwear.
Figure 2:
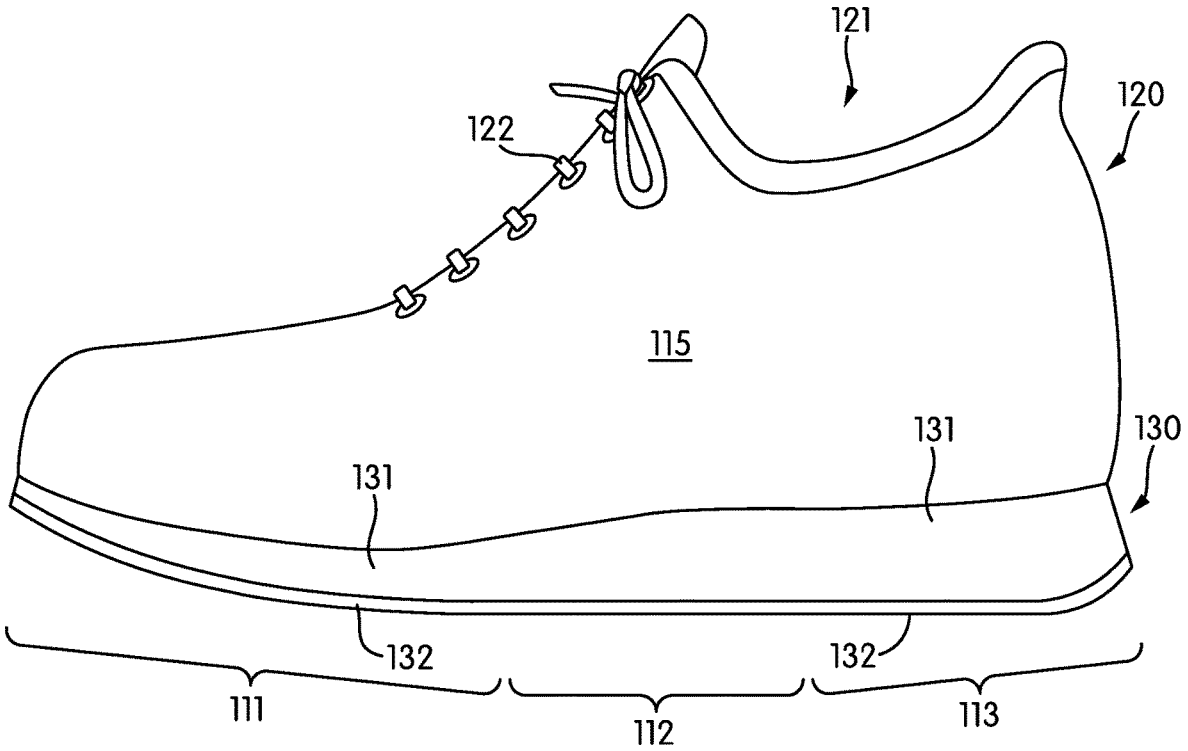
FIG. 2 is a medial side elevational view of the article of footwear.

An article of footwear 110 is depicted in FIGS. 1 and 2 as including an upper 120 and a sole structure 130. For reference purposes, footwear 110 may be divided into three general regions: a forefoot region 111, a midfoot region 112, and a heel region 113, as shown in FIG. 1. Footwear 110 also includes a lateral side 114 and a medial side 115. Forefoot region 111 generally includes portions of footwear 110 corresponding with the toes and the joints connecting the metatarsals with the phalanges. Midfoot region 112 generally includes portions of footwear 110 corresponding with the arch area of the foot. Heel region 113 generally includes portions of footwear 110 corresponding with rear portions of the foot, including the calcaneus bone. Lateral side 114 and medial side 115 extend through each of regions 111-113 and correspond with opposite sides of footwear 110.

Regions 111-113 and sides 114-115 are not intended to demarcate precise areas of footwear 110. Rather, regions 111-113 and sides 114-115 are intended to represent general areas of footwear 110 to aid in the following discussion. In addition to footwear 110, regions 111-113 and sides 114-115 may also be discussed with respect to the individual elements thereof, such as upper 120 and sole structure 130, and to the foot itself.

Upper 120 is depicted as having a substantially conventional configuration incorporating a variety of material elements (e.g., textile, foam, leather, and synthetic leather) that are stitched or adhesively bonded together to form an interior void for securely and comfortably receiving a foot. The material elements may be selected and located with respect to upper 120 in order to selectively impart properties of durability, air-permeability, wear-resistance, flexibility, and comfort, for example. An ankle opening 121 in heel region 113 provides access to the interior void. In addition, upper 120 may include a lace 122 that is utilized in a conventional manner to modify the dimensions of the interior void, thereby securing the foot within the interior void and facilitating entry and removal of the foot from the interior void. Lace 122 may extend through apertures in upper 120, and a tongue portion of upper 120 may extend between the interior void and lace 122.

Given that various aspects of the present application primarily relate to sole structure 130, upper 120 may exhibit the general configuration discussed above or the general configuration of practically any other conventional or non-conventional upper. Accordingly, the overall structure of upper 120 may vary significantly.

Sole structure 130 is secured to upper 120 and has a configuration that extends between upper 120 and the ground. In effect, therefore, sole structure 130 is located to extend between the foot and the ground. In addition to attenuating ground reaction forces (i.e., providing cushioning for the foot), sole structure 130 may provide traction, impart stability, and limit various foot motions, such as pronation.

The primary elements of sole structure 130 are a midsole 131 and an outsole 132. Midsole 131 may include a fluid-filled chamber. In addition, midsole 131 may incorporate one or more additional footwear elements that enhance the comfort, performance, or ground reaction force attenuation properties of footwear 110, including a polymer foam material, such as polyurethane or ethylvinylacetate, plates, moderators, lasting elements, or motion control members. Outsole 132, which may be absent in some configurations of footwear 110, is secured to a lower surface of midsole 131 and may be formed from a rubber material that provides a durable and wear-resistant surface for engaging the ground. In addition, outsole 132 may also be textured to enhance the traction (i.e., friction) properties between footwear 110 and the ground.

Sole structure 130 may also incorporate an insole or sockliner that is located within the void in upper 120 and adjacent (i.e., located nearby or close to, although not necessarily in contact with) a plantar surface or lower surface of the foot to enhance the comfort of footwear 110. A plate may be operably received within or below the midsole to improve support.

Figure 3:
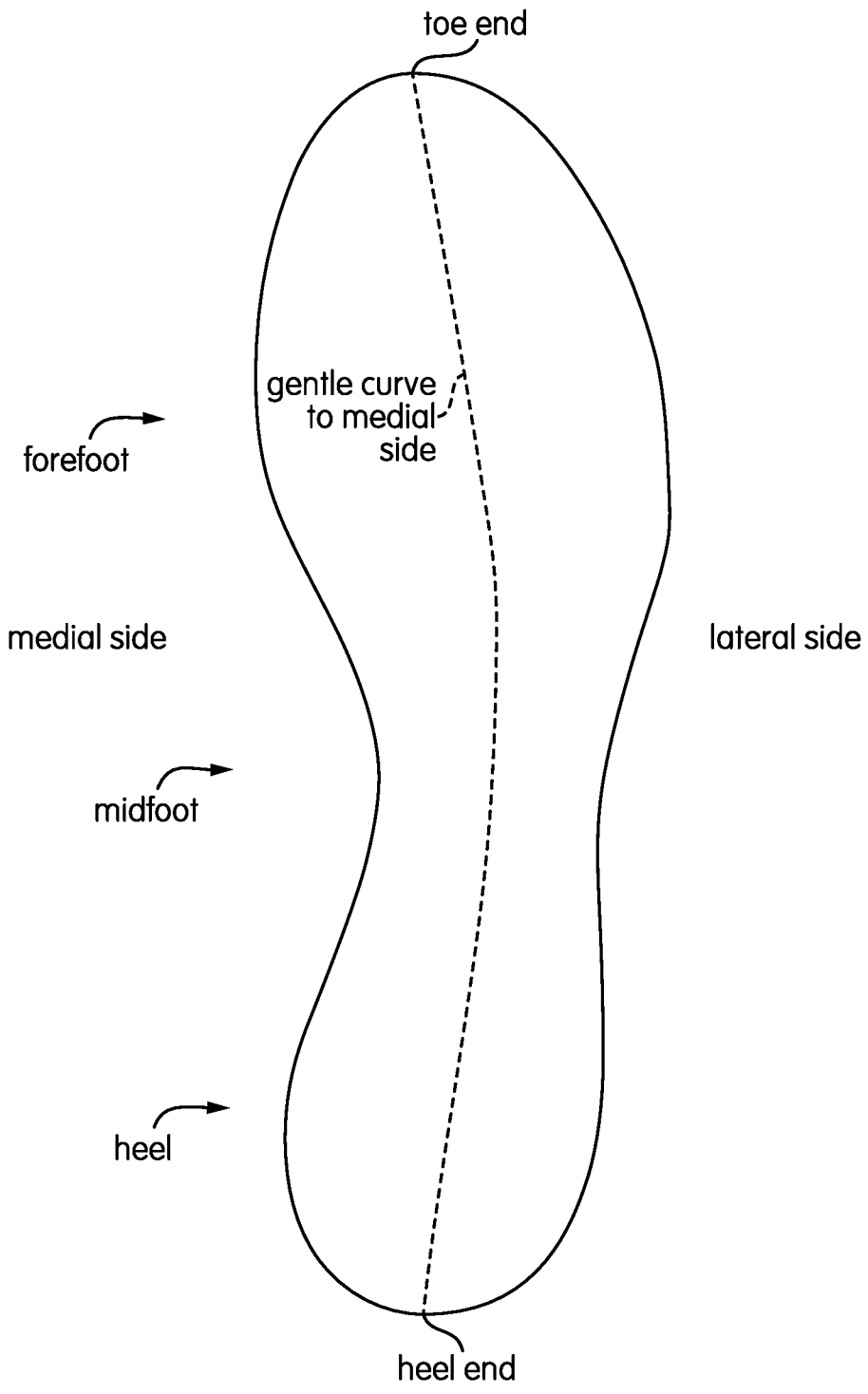
FIG. 3 defines a generic footwear sole shape.

In general, a footwear sole structure shape may have a heel region, a midfoot region, and a forefoot region, a heel end at a rear-most part of the heel region, a toe end at a forward-most part of the forefoot region, a medial side, and a lateral side. The heel region may be narrower than a central portion of the forefoot region. A path from the heel end to the toe that remains generally equidistant from the medial and lateral sides may have a gentle curve toward the medial side. The forefoot region may have a rounded taper toward the toe end. Optionally the shape may be pinched inward on the medial and/or lateral sides in the midfoot region. A non-limiting example of a generic footwear sole shape is shown in FIG. 3.

In accordance with aspects of the invention described in more detail below, the sole structure may further contain a substantially incompressible support structure such as a plate to stiffen the medial side of the shoe's forefoot about the long axis. The support structure may be positioned or wedged between the outsole 132 and the midsole 131, the midsole 131 and an insole, or the outsole 132 and the insole if no midsole is present.

Figure 4A:
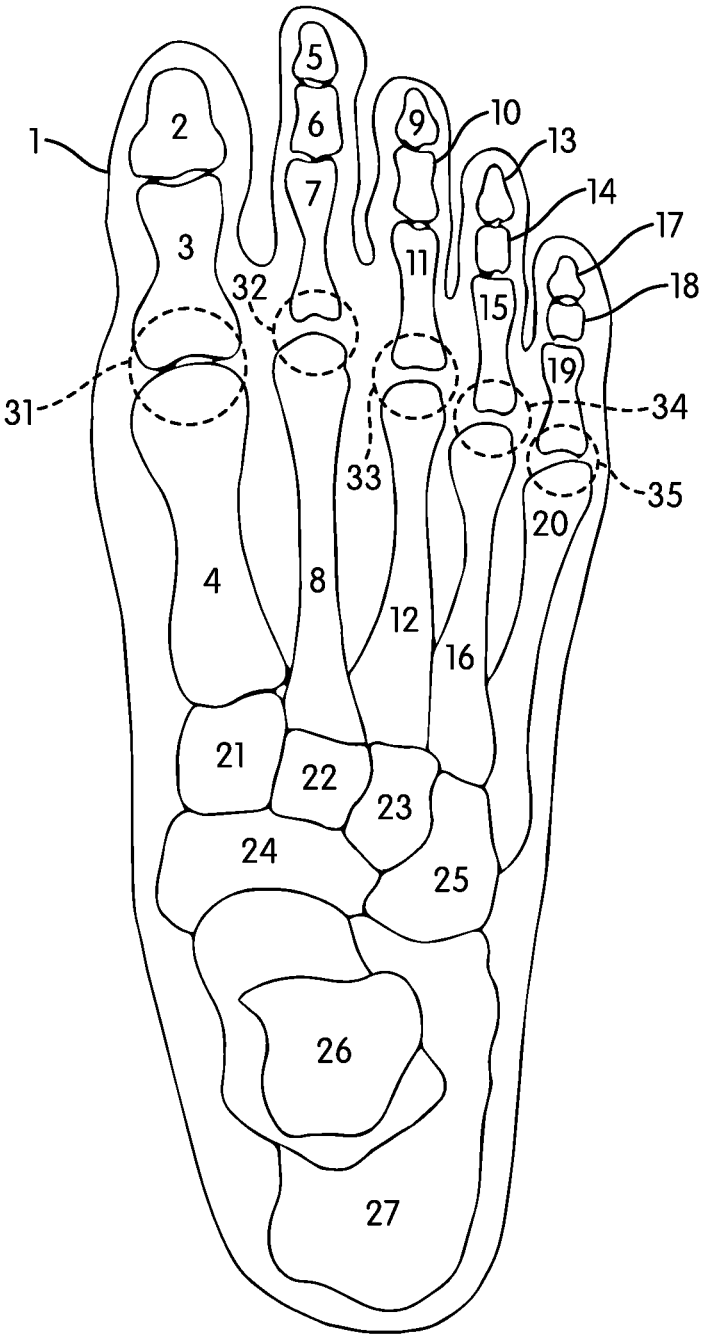
FIGS. 4A and 4B identify regions and bones of the human foot.
Figure 4B:
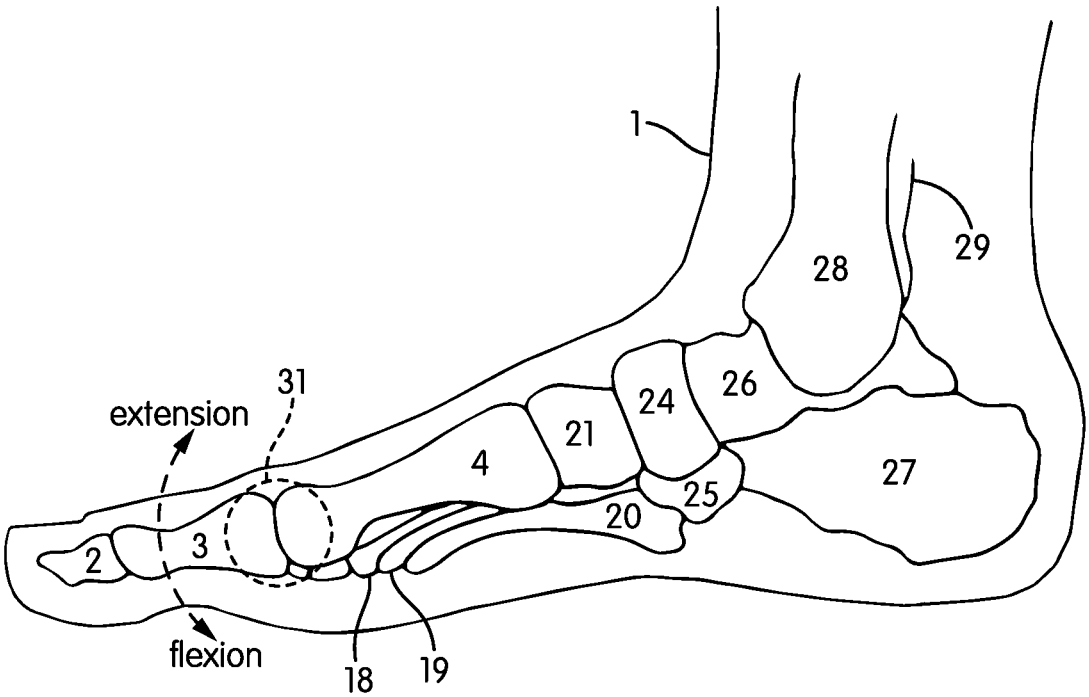

Shoe elements can be described based on regions and/or anatomical structures of a human foot wearing that shoe, and by assuming that the interior of the shoe generally conforms to and is otherwise properly sized for the wearing foot. FIG. 4A shows outlines of bones in a human right foot 1 from a dorsal, or top, view. Those bones are the first distal phalanx 2, the first proximal phalanx 3, the first metatarsal 4, the second distal phalanx 5, the second middle phalanx 6, the second proximal phalanx 7, the second metatarsal 8, the third distal phalanx 9, the third middle phalanx 10, the third proximal phalanx 11, the third metatarsal 12, the fourth distal phalanx 13, the fourth middle phalanx 14, the fourth proximal phalanx 15, the fourth metatarsal 16, the fifth distal phalanx 17, the fifth middle phalanx 18, the fifth proximal phalanx 19, the fifth metatarsal 20, the medial cuneiform 21, the intermediate cuneiform 22, the lateral cuneiform 23, the navicular 24, the cuboid 25, the talus 26, and the calcaneus 27. FIG. 4B is a medial side view of bones in foot 1. Also shown in FIG. 4B are portions of the two lower leg bones: the tibia 28 and the fibula 29. These lower leg bones are movably attached to the talus 26. The exact shape and size of the bones in a foot will vary from individual to individual, and FIGS. 4A and 4B are merely intended as convenient general references.

A forefoot region of a foot includes the heads and bodies of the metatarsals 4, 8, 12, 16, and 20, as well as the phalanges 2, 3, 5-7, 9-11, 13-15, and 17-19. A forefoot element of a shoe is an element having one or more portions located under, over, to the lateral and/or medial side of, and/or in front of a wearer's forefoot (or portion thereof) when the shoe is worn. A midfoot region of a foot includes the cuboid 25, navicular 24, and cuneiforms 21-23, as well as the bases of the metatarsals 4, 8, 12, 16, and 20. A midfoot element of a shoe is an element having one or more portions located under, over, and/or to the lateral and/or medial side of a wearer's midfoot (or portion thereof) when the shoe is worn. A hindfoot region of a foot includes the talus 26 and calcaneus 27. A hindfoot element of a shoe is an element having one or more portions located under, to the lateral and/or medial side of, and/or behind a wearer's hindfoot (or portion thereof) when the shoe is worn. The forefoot region may overlap with the midfoot region, as may the midfoot and hindfoot regions.

Unless indicated otherwise, a longitudinal axis refers to a horizontal heel-toe axis along the center of the foot that is roughly parallel to a line along the second metatarsal and second phalanges. A transverse axis refers to a horizontal axis across the foot that is generally perpendicular to a longitudinal axis. A longitudinal direction is generally parallel to a longitudinal axis. A transverse direction is generally parallel to a transverse axis.

The metatarsophalangeal joints of a human foot are the joints between the metatarsal heads and the proximal phalanges. A first metatarsophalangeal joint 31 connects the first proximal phalanx 3 and the head of first metatarsal 4. A second metatarsophalangeal joint 32 connects the second proximal phalanx 7 and the head of second metatarsal 8. A third metatarsophalangeal joint 33 connects the third proximal phalanx 11 and the head of third metatarsal 12. A fourth metatarsophalangeal joint 34 connects the fourth proximal phalanx 15 and the head of fourth metatarsal 16. A fifth metatarsophalangeal joint 35 connects the fifth proximal phalanx 19 and the head of fifth metatarsal 20.

Support Structure Configuration

A substantially incompressible support structure may be used in the footwear to stiffen the medial side of the shoe's forefoot about the long axis. Substantially incompressible is defined herein as wherein the material resists compression when a force is applied during expected use of the footwear. The support structure may be positioned or wedged between the outsole and the midsole, the midsole and the insole, or the outsole and the insole if no midsole is present. The midsole or insole may have a cavity or recess therein in which the support structure may be placed so as to be flush with the surface of the midsole or insole. Further, the support structure may be embedded within the midsole, for example, within a pocket formed within the midsole. For ease of discussion, the application will be discussed in terms of the support structure being attached to or recessed in the midsole.

The substantially incompressible support structure minimizes the ability of the medial forefoot region of the midsole to bend, thus holding the midsole flat in such region. The support structure may extend from a medial edge of the midsole to at least a longitudinal center line of the midsole, for example, the support structure may extend across at least sixty percent, at least seventy percent, at least eighty percent, at least ninety percent, and up to one hundred percent of the distance from the medial edge of the midsole toward the lateral edge of the midsole. In some examples, a support structure generally does not extend more than ninety percent of the distance from the medial edge of the midsole toward the lateral edge of the midsole.

In footwear, referencing the foot, the support structure may be positioned in the footwear so as to be under at least portions of the first proximal phalanx 3, the first metatarsal 4 including the first metatarsophalangeal joint 31, the second metatarsal 8, and the third metatarsal 12. The support structure may be further positioned under at least a portion of the fourth metatarsal 16, and/or at least portions of the second metatarsophalangeal joint 32, second proximal phalanx 7, the third metatarsophalangeal joint 33, the third proximal phalanx 11, the fourth metatarsophalangeal joint 34, and/or the fourth proximal phalanx 15.

It is believe that such support structure keeps a soft foam midsole flatter during side-to-side or lateral movements such as banking and reduce the "tube sock" effect. Such support structure provides larger average lateral forces and shorter ground contact times during lateral movements. This method of keeping the midsole flat may allow for the use of softer foams while maintaining stability and containment, may improve the containment of the upper, and may improve traction by increasing the contact area between the outsole and ground.

The support structure may be adhered to or otherwise anchored to the midsole. Suitable adhesives include, but are not limited to glues, cements, epoxies, pastes. Other means to anchor to the midsole include, but are not limited to, fasteners such as, rivets. An outsole may be attached to the midsole, covering all or any part of exposed support structure.

The substantially incompressible support structure may be a plate or multiple plates, for example at least two plates or at least three plates. The plate(s) is/are attached to a top or bottom surface of a midsole foam, recessed into the top or bottom surface of the midsole foam, or embedded within the midsole foam.

Figure 5:
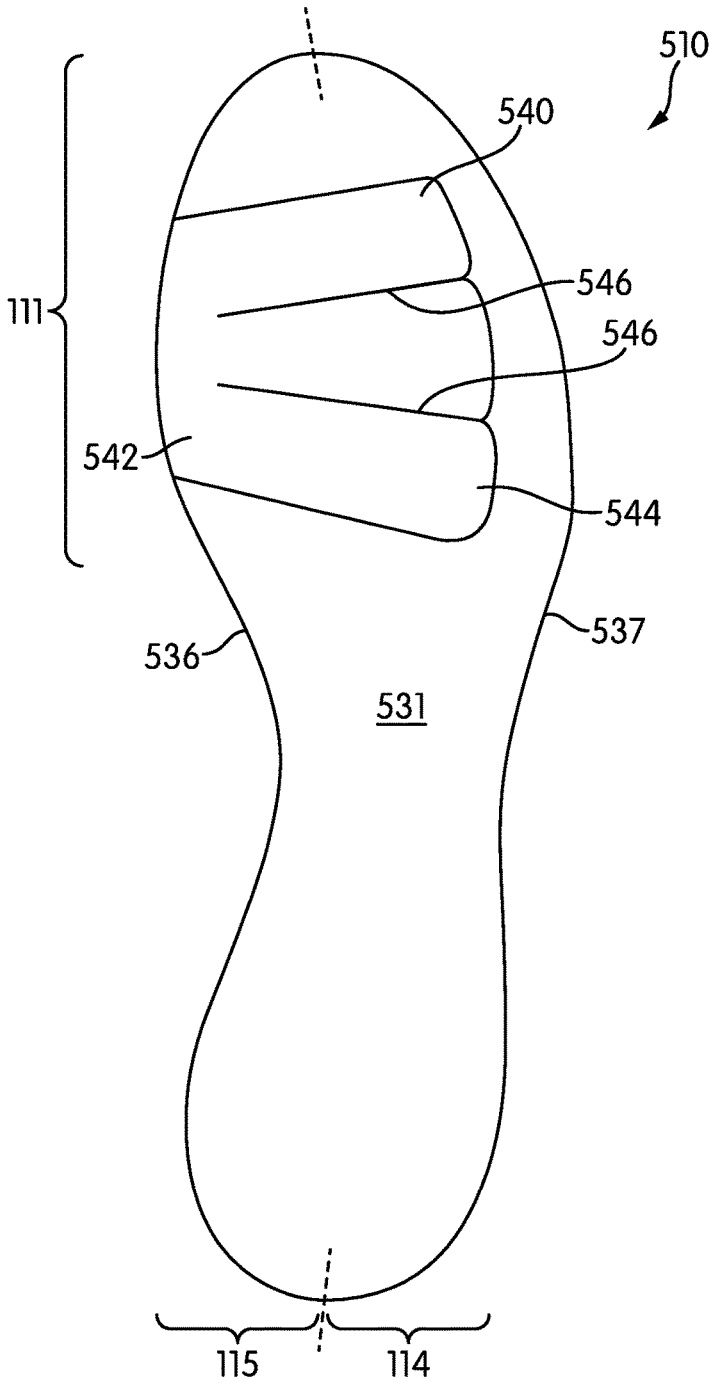
FIG. 5 is a bottom view of a midsole of a sole structure of an article of footwear.
Figure 5A:
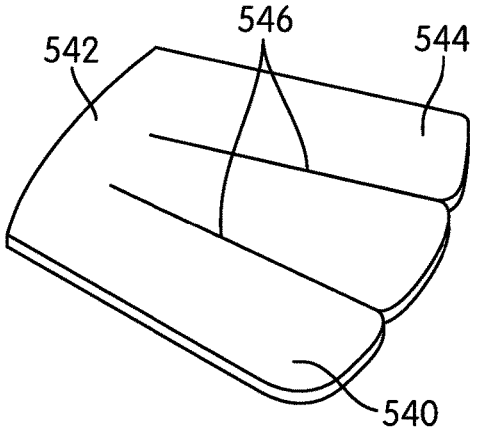
FIG. 5A is a perspective view of the plate in FIG. 5.

FIG. 5 is a bottom view of an example midsole 531 of an article of footwear incorporating a plate 540 in the forefoot region 111. The plate 540 has a first side 542 and a second side 544. As depicted, first side 542 is positioned on medial side 515 of footwear 510 and second side 544 is positioned on lateral side 514 of footwear 510. In one aspect, first side 542 of plate 540 is positioned adjacent to a medial peripheral edge 536 of midsole 531 and second side 544 is positioned inward from lateral peripheral edge 537 of midsole 531. Plate 540 may be attached to the surface of, or recessed within, the midsole 531. FIG. 5A is a perspective view of plate 540. Plate 540 may be attached to the upper or lower surface of the midsole (where the midsole upper surface could be attached to Strobel or other lasting element, or may form interior bottom surface of shoe (e.g., if upper attached only at edges of midsole.)

Plate 540 may be a single piece support structure having at least one, at least two, or at least three sipes or slits. Such sipes extend from a point at or near the medial side of the plate to the lateral side of the plate. For example, as shown in FIG. 5A, plate 540 has sipes 546. The sipes allow for fore-to-rear foot flexibility while remaining stiff laterally. The sipes are depicted as lines, but may be waves or undulations or the like.

The length and width of the plate depends on the size of the shoe. As a non-limiting example, a U.S. size 10 adult male shoe may have a plate that is approximately 2 inches long and approximately 2 to 3 inches wide.

Figure 6:
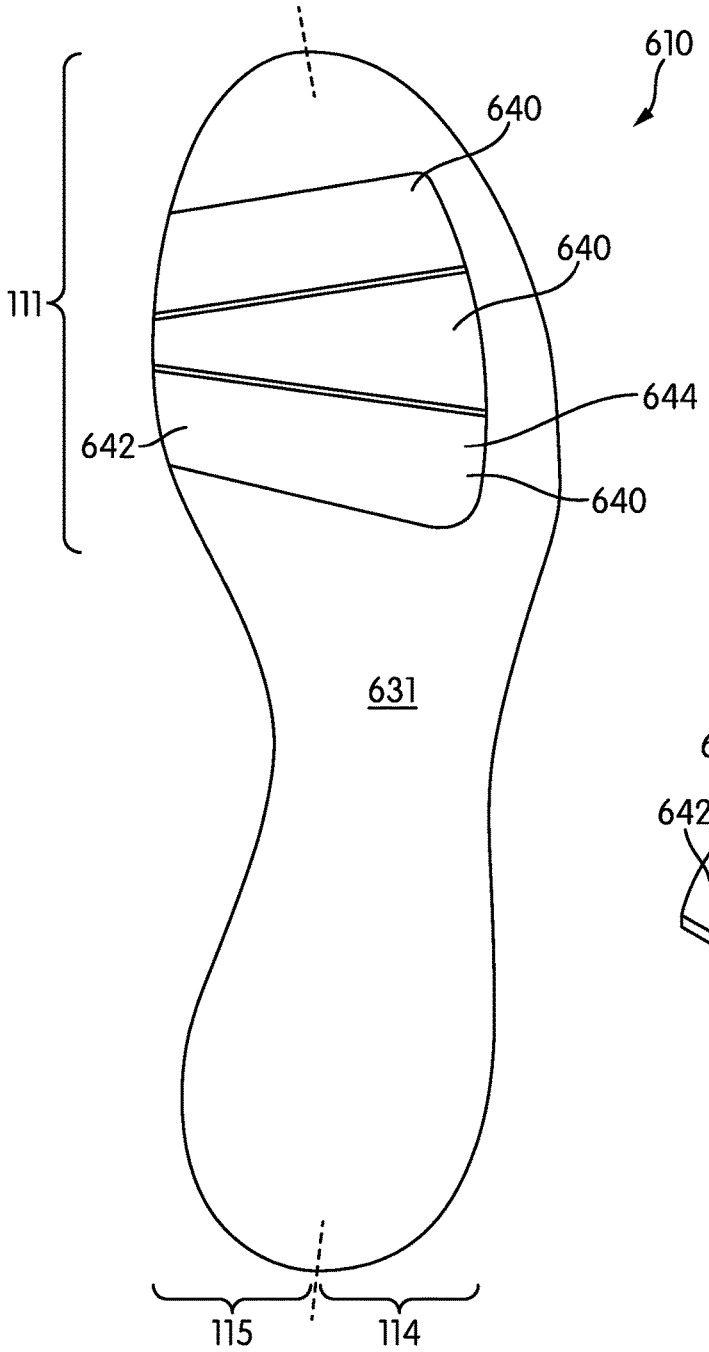
FIG. 6 is a bottom view of another example midsole of a sole structure of an article of footwear.
Figure 6A:
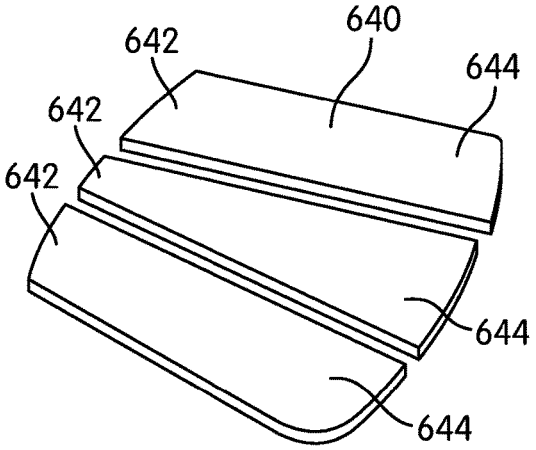
FIG. 6A is a perspective view of the plates in FIG. 6.

FIG. 6 is a bottom view of an example midsole 631 of an article of footwear incorporating a plate 640 in the forefoot region 111. Plates 640 each have a first side 642 and a second side 644. As depicted, first sides 642 are positioned on medial side 615 of footwear 610 and second sides 644 are positioned on the lateral side 614 of footwear 610. In one aspect, first sides 642 of plates 640 are positioned adjacent to a medial peripheral edge 636 of midsole 631 and second sides 644 are positioned inward from lateral peripheral edge 637 of midsole 631. Plates 640 may be attached to the surface of, or recessed within, midsole 631. FIG. 6A is a perspective view of plates 640.

Additionally, while plates 540 and 640 are depicted in FIGS. 5-6 as layer(s) of uniformly thick material, plates 540 and 640 may in some configurations have a non-uniform thickness, i.e., a thickness of a plates 540 and 640 may vary between portions of plates 540 and 640. For example, in various configurations, first sides 542 and 642, second sides 544 and 644, or both may taper to their respective edges.

FIGS. 5-6 depict plate 540 and collectively plates 640 as having overall substantially trapezoidal configurations. However other overall configurations may be suitable such as rectangles.

Plates 540 and 640 may be formed from or may otherwise include any of a variety of materials that are generally more rigid than the polymer foam material of the midsole including metal, plastic, or composite. For example, plates 540 and 640 may be formed from a polyester material such as a thermoplastic polyurethane (TPU). Other materials that may also be used for plates 540 and 640 include: an injection-molding-grade thermoplastic or thermoset polymer material; a composite material, such as a fiber-reinforced polymer material, or carbon fiber material; an engineered textile with a fused adhesive skin; or a multi-material laminate structure. The material and thickness of plates 540 and 640 may accordingly allow the support and cushioning to be optimized for a particular activity, or type of athlete. Generally, the plate may be as thin as possible while still providing the desired rigid support, e.g., less than 10 mm. For example, thickness may range from 1 mm to 8 mm, from 1 mm to 6 mm, from 1 to 5 mm, or 1 to 4 mm.

Plates 540 and 640 do not interfere with normal cushioning and support offered by the polymer foam of midsoles 531 and 631 respectively, thereby allowing substantially symmetric medio-lateral support and cushioning during such activities as standing, walking, or running.

Although midsoles 531 and 631 are depicted in FIGS. 5-6 as only including a polymer foam material and plates 540 and 640, midsole 131 may include other features, such as other types of plates, moderators, fluid-filled chambers, lasting elements, or motion control members.

Figure 7A:
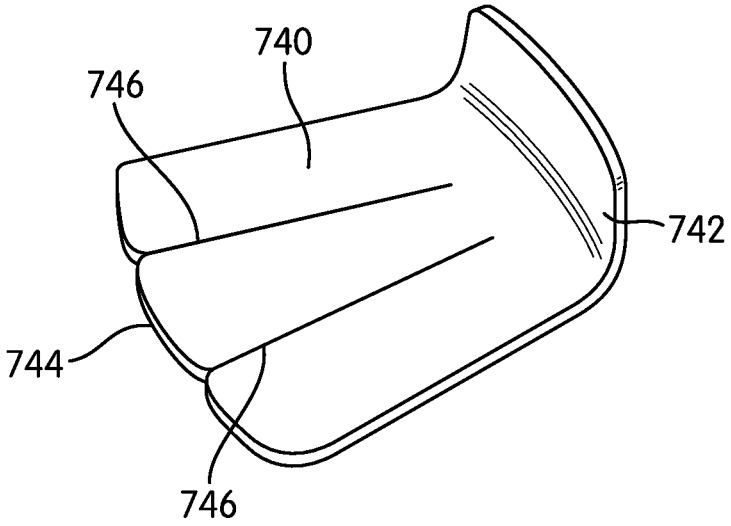
FIG. 7A is a perspective view of an example plate having a medial wrap.
Figure 7B:
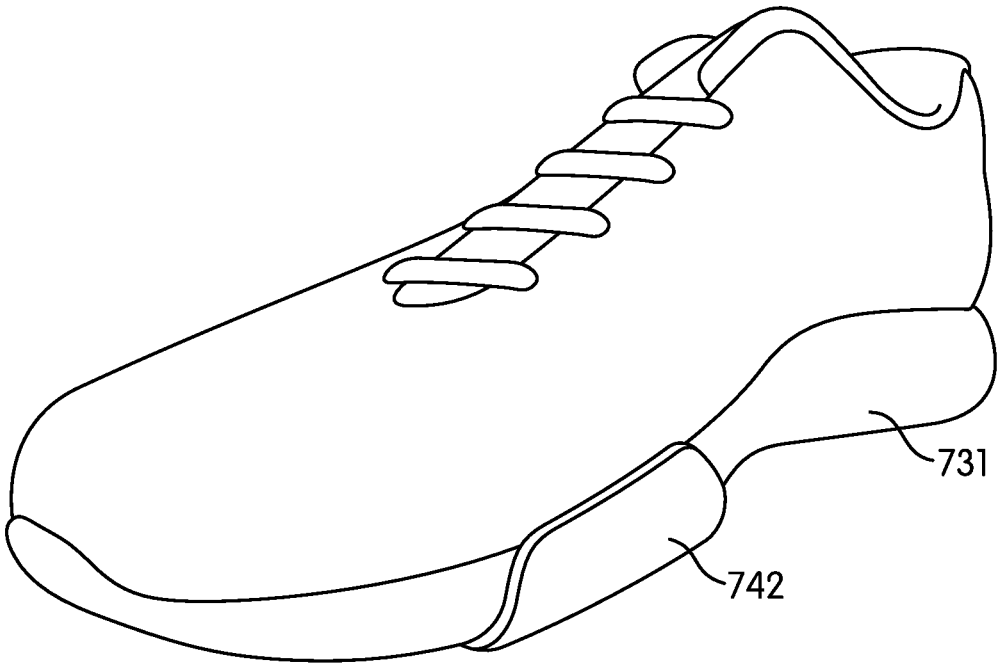
FIG. 7B is a side view of an article of footwear having the plate of FIG. 7A attached to an outsole.

FIG. 7A is a view of plate 740. Similar to plate 540, plate 740 has sipes 746 on the lateral side 744 which allow for fore-to-rear foot flexibility. In this aspect, medial side 742 extends upward to wrap upward the medial side of the midsole. FIG. 7B shows a medial side view of footwear having an midsole 731 (which also serves as an outsole in this aspect) showing the medial side of plate 740 extending to wrap upward the medial side of the midsole. The medial side 742 may wrap up a portion of, or the entirety of, the medial side of the outsole or wrap further up over part of the upper. Plate 740 may be formed and configured as described above for plates 540.

Figure 7C:
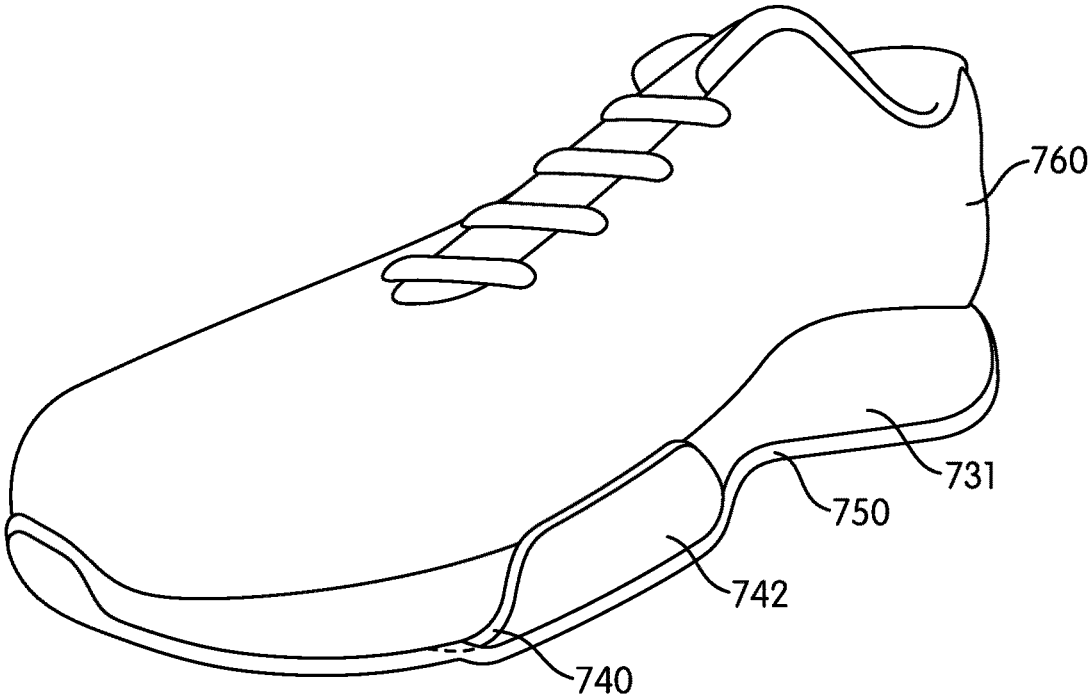
FIG. 7C is a side view of an article of footwear having the plate of FIG. 7A attached between a midsole and an outsole.
Figure 7D:
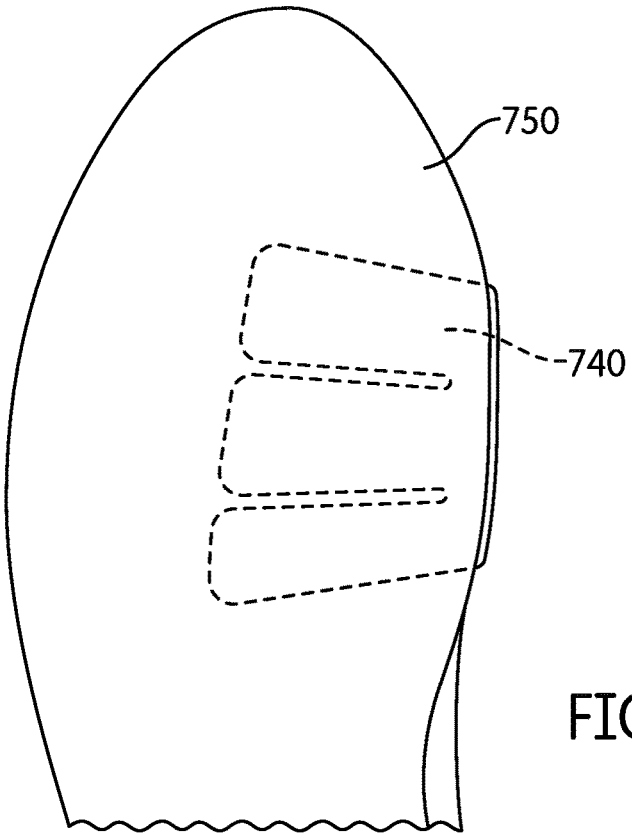
FIG. 7D is a bottom view of an article of footwear having the plate of FIG. 7A attached between a midsole and an outsole as depicted in FIG. 7C.

FIG. 7C shows a medial side view of footwear having an outsole 750, a midsole 731, and an upper 760, and a plate 740 positioned between outsole 750 and midsole 731. The medial side of plate 740 extending to wrap upward the medial side of the midsole 731. The medial side 742 may wrap up a portion of, or the entirety of, the medial side of the midsole or wrap further up over part of the upper 760. Plate 740 may be formed and configured as described above for plates 540. FIG. 7D depicts the bottom view of the footwear of FIG. 7C having an outsole 731 with the plate 740 positioned between outsole 750 and midsole 731.

Figure 7E:
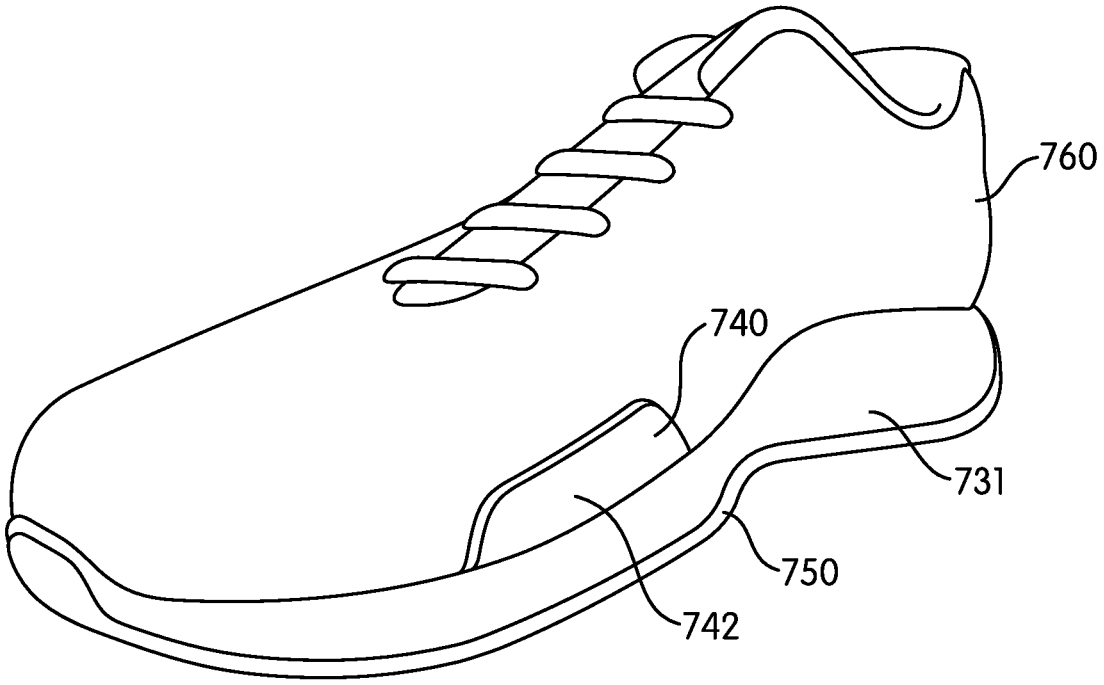
FIG. 7E is a side view of an article of footwear having the plate of FIG. 7A attached between the insole and the midsole.

FIG. 7E shows a medial side view of footwear having an outsole 750, a midsole 731, and an upper 760, and a plate 740 positioned between midsole 731 and upper 760. The medial side of plate 740 extending to wrap upward the medial side of the upper 760.

Figure 8A:
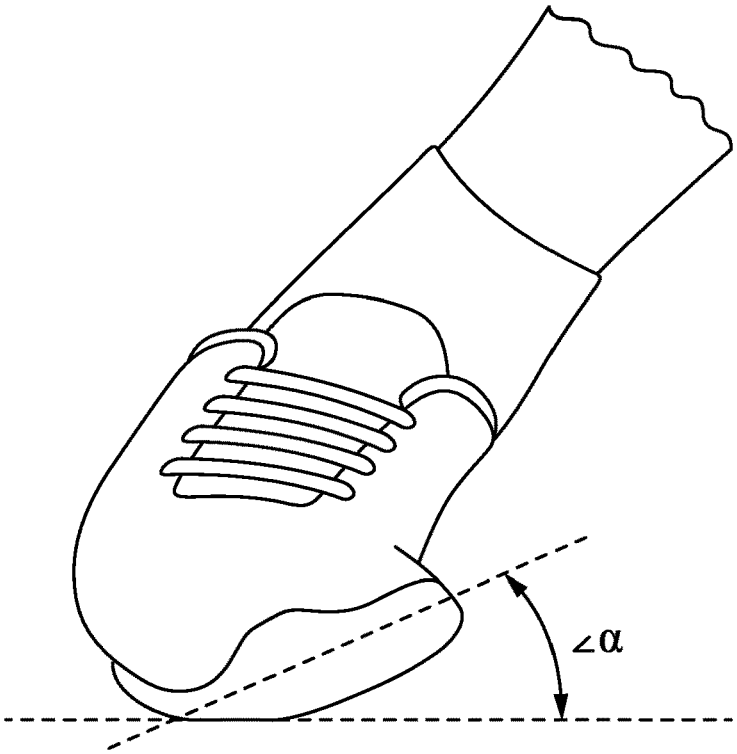
FIG. 8A depicts the effect of "tube socking" on the angle of contact between a footwear midsole and the ground during banking.
Figure 8B:
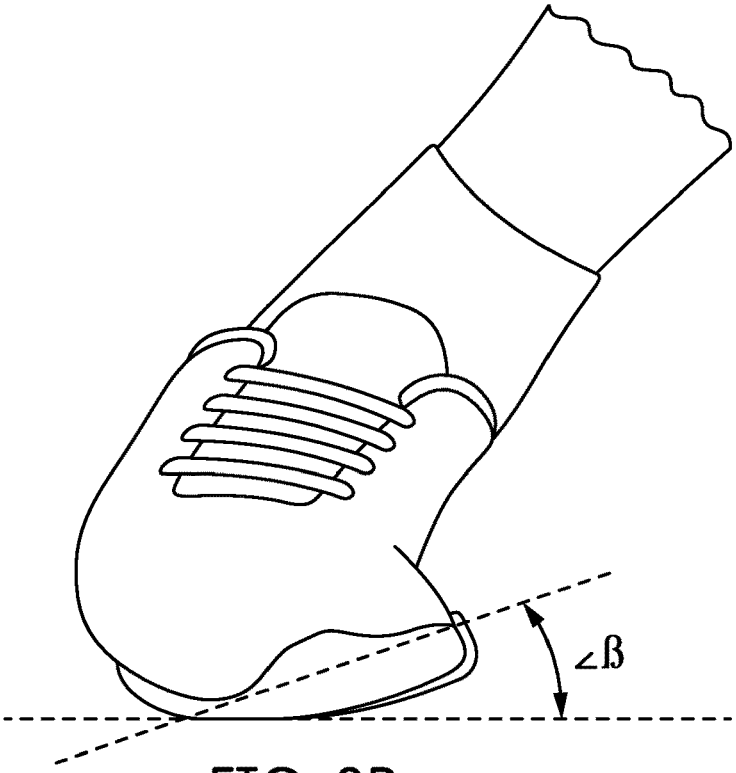
FIG. 8B depicts the effect of adding a plate to the midsole of FIG. 8A on the angle of contact between a footwear midsole and the ground during banking.

FIG. 8A illustrates the effect of "tube socking" on the angle of contact $\alpha$ between a footwear midsole and the ground during banking e.g., pushing off to the side from a medial of the foot. FIG. 8B illustrates the effect of adding a plate to the midsole of FIG. 8A on the angle of contact $\beta$ between a footwear midsole and the ground during banking. Angle $\beta$ is a smaller angle of contact than angle $\alpha$. A banking force may have both a downward or vertical component as well as a lateral or side-to-side component. Midsoles 531, 631, 731 and plates 540, 640, 740 positioned as described provide unique support properties during banking to prevent or reduce the effect of "tube socking". FIG. 8A and FIG. 8B are shown without an outsole for illustration purposes. The described support properties afforded by the plates occur with an outsole in place.

Figure 9:
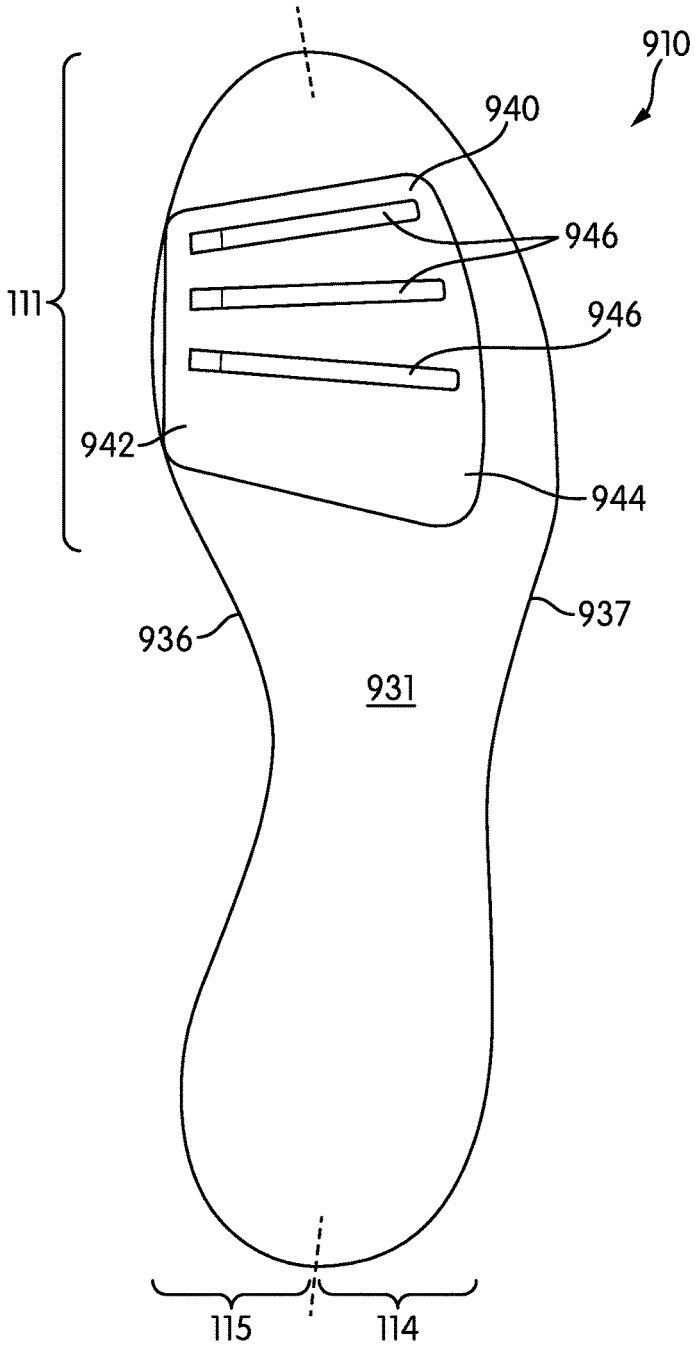
FIG. 9 is a bottom view of another example midsole of a sole structure of an article of footwear.
Figure 9A:
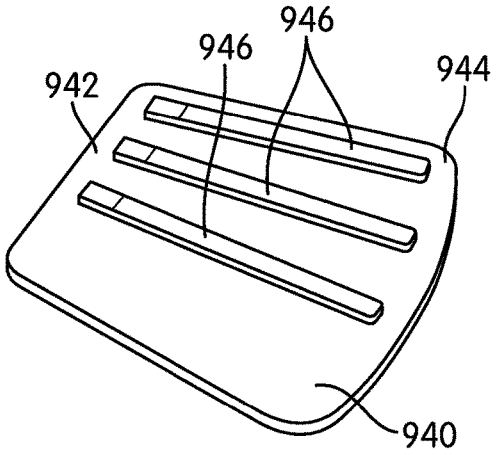
FIG. 9A is a perspective view of the plate having rails in FIG. 9.

FIG. 9 depicts an aspect of footwear 910 incorporating a plate 940 in the forefoot region 111 of midsole 931. The plate 940 has a first side 942 and a second side 944. As depicted, first side 942 is positioned on medial side 915 of footwear 910 and second side 944 is positioned on lateral side 914 of footwear 910. In one aspect, first side 942 of plate 940 is positioned adjacent to a medial peripheral edge 936 of midsole 931 and positioned inward from lateral peripheral edge 937 of midsole 931. Plate 940 may be attached to the surface of, or recessed within, the midsole 931. FIG. 9A is a perspective view of plate 940. Plate 940 may be attached to the upper or lower surface of the midsole (where the upper surface is attached to an inner and a lower surface is attached to an outsole.) Plate 940 may be formed and configured as described above for plates 540.

The plate 940 may be a single piece support structure having at least one, at least two, or at least three rails. Such rails extend from a point at or near the medial side of the plate to the lateral side of the plate. For example, as shown in FIG. 9A, plate 940 has rails 946. Fore-to-rear foot flexibility is permitted between the rails while allowing the footwear to remain stiff laterally. The rails may be spaced apart in an evenly or unevenly and may be parallel to each other or at an angle to each other. The rails may be the same length and width or may be of different lengths and/or widths.

Figure 10A:
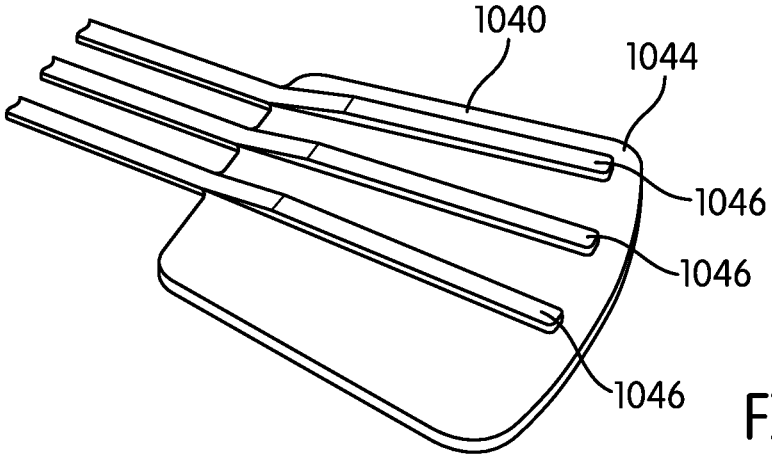
FIG. 10A is a perspective view of an example plate having extended rails with even spacing between rails.
Figure 10B:
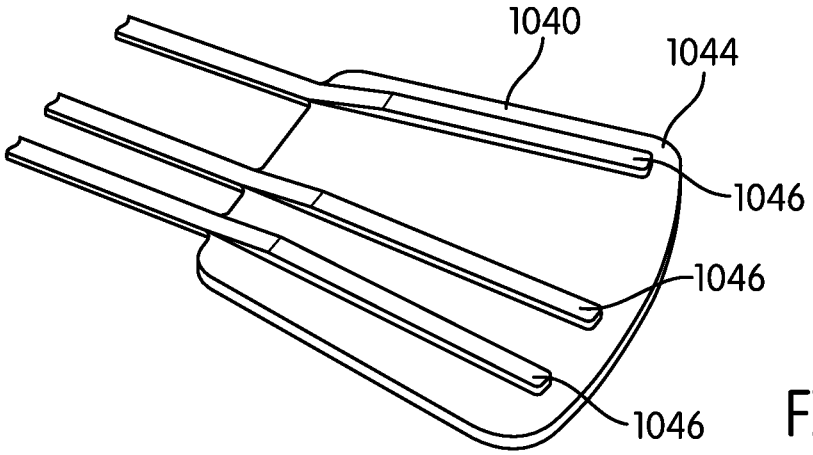
FIG. 10B is a perspective view of an example plate having extended rails with uneven spacing between rails.
Figure 10C:
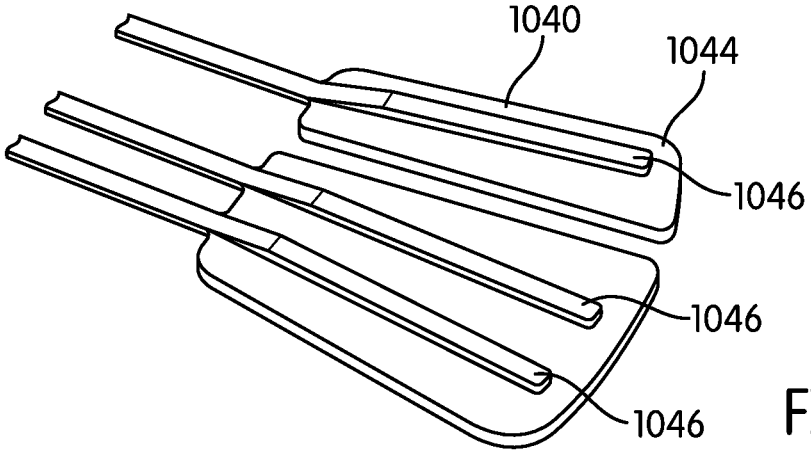
FIG. 10C is a perspective view of an example plate having two extended rails and a separate plate with one extended rail.

FIG. 10A depicts rails spaced in an even manner whereas FIG. 10B depicts rails spaced in an uneven manner. Further FIGS. 10A and 10B show that the rails may extend off the plate such that the rails 1046 may wrap upward around the footwear. FIG. 10C depicts two rails on one plate and one rail on a narrower plate. Any excess rail portions may be cut off.

Figure 11:
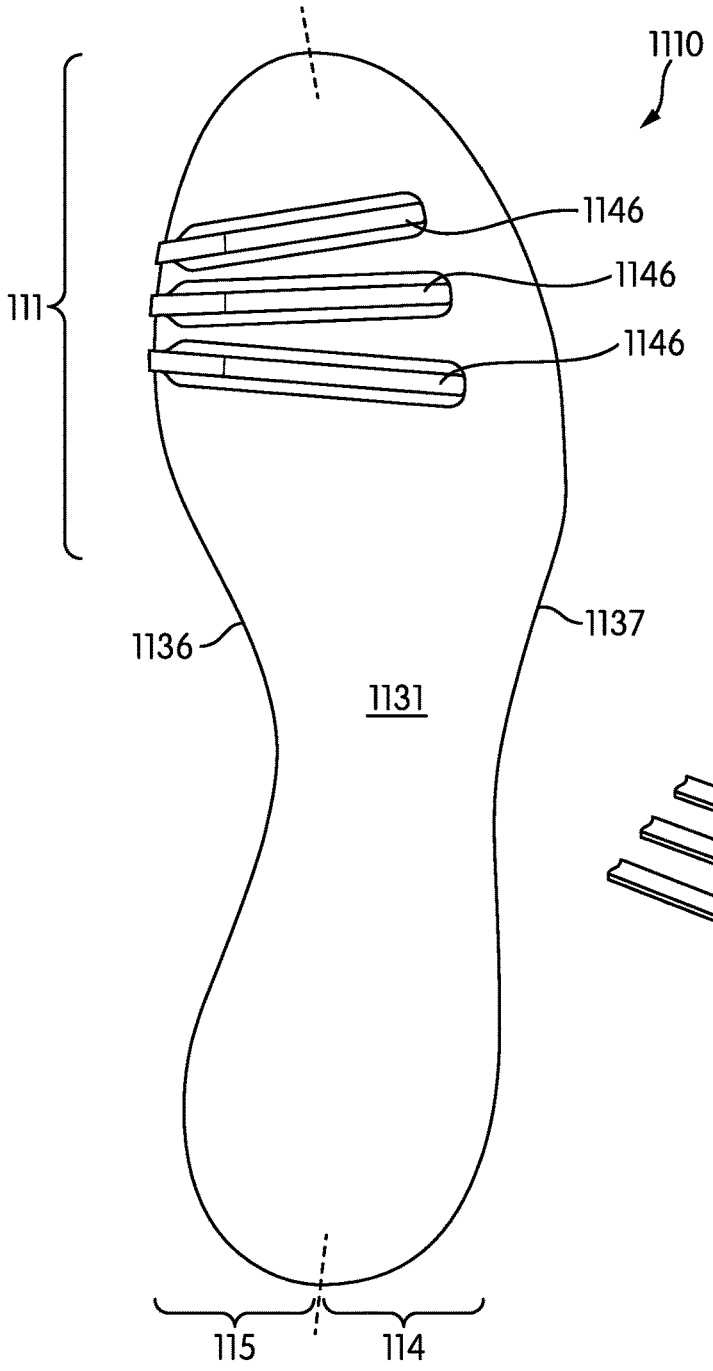
FIG. 11 is a bottom view of another example midsole of a sole structure of an article of footwear.
Figure 11A:
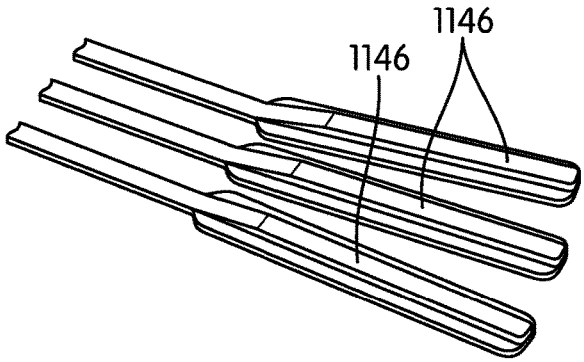
FIG. 11A is a perspective view of narrow plates having rails in FIG. 10.

FIG. 11 depicts another aspect footwear 1110 as incorporating multiple narrow plates with rails 1140 that are positioned adjacent each other in forefoot region 111. The plates 1140 each have a first side 1142 and a second side 1144. As depicted, first sides 1142 are positioned on medial side 1115 of footwear 1110 and second sides 1144 are positioned on the lateral side 1114 of footwear 1110. Plates 1140 are adjacent to a medial peripheral edge 1136 of midsole 1131 and spaced inward from lateral peripheral edge 1137 of midsole 1131. Plates 1140 may be attached to the surface of, or recessed within, midsole 1031. FIG. 11A is a perspective view of plates 1140. Plate 1140 may be formed and configured as described above for plates 640.

Figure 12A:
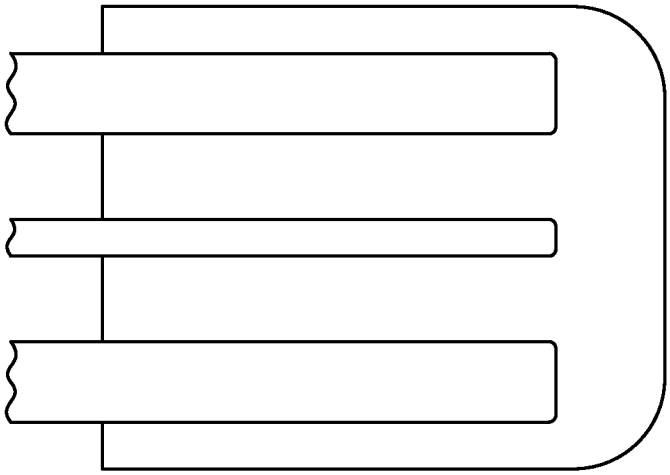
FIG. 12A is a perspective view of an example plate having extended rails of different widths.
Figure 12B:
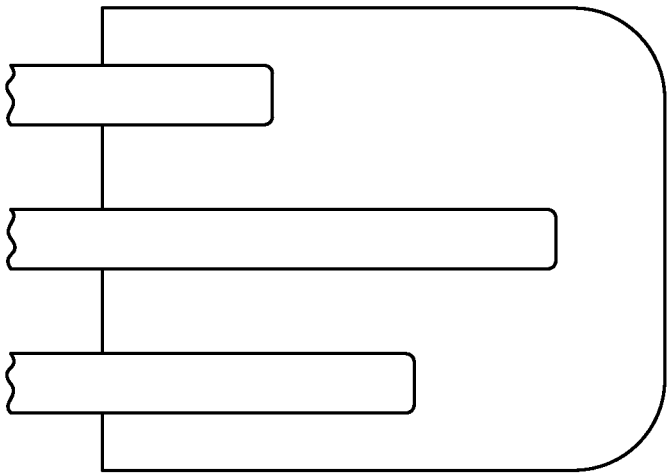
FIG. 12B is a perspective view of an example plate having extended rails of different lengths.
Figure 13A:
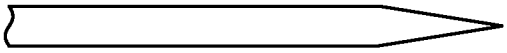
FIGS. 13A-I depict exemplary rail shapes.
Figure 13B:
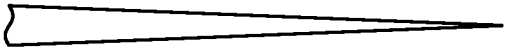
Figure 13C:
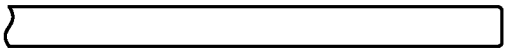
Figure 13D:
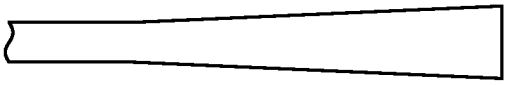
Figure 13E:
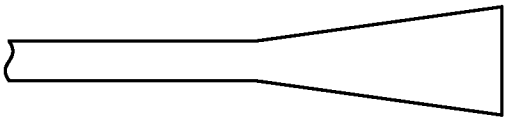
Figure 13F:
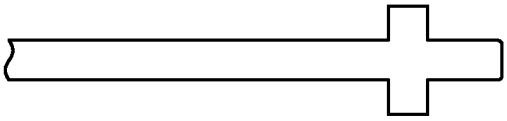
Figure 13G:
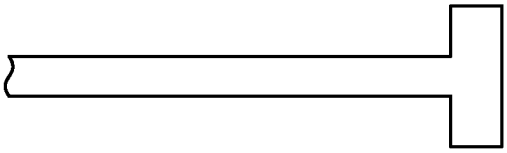
Figure 13H:
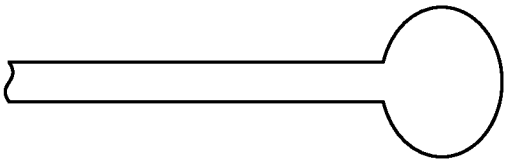
Figure 13I:
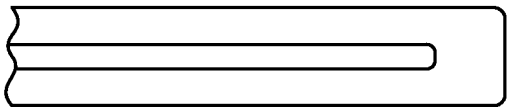

The rails may be any suitable, shape, length and width. The rails may be of the same shape, length and width or the rails may differ by one or more of shape, length and width. FIG. 12A shows two wide rails with a narrower rail positioned between the wider rails. FIG. 12 B depicts rails of various lengths.

Likewise the rails may be of any suitable shape such as, but not limited to, the rails depicted in FIGS. 13A-I.

The rails and plates may be prepared with carbon fiber or substantially incompressible plastics wrapped with carbon fiber. If rails have a length that extend up a side of the footwear, all or part of the portion of the rails that extend upwardly may be made of plastic without the carbon fiber. For example, only a portion of the rails that are attached to a plate may be wrapped with carbon fiber. The rails may be flexible to accommodate flexing of the midsole. The rails may be of any suitable thickness. They may taper at one or more ends.

The rails may be made in any suitable manner such as by 3D printing and then shaped by heating. The heating step may provide a gluing effect.

The examples which follow are intended as an illustration of certain preferred embodiments of the invention, and no limitation of the invention is implied.

Example 1

Athletes tested and compared a control shoe having a midsole and a shoe having a plated midsole. See illustrated comparison of results using non-plated midsole of FIG. 8A and plated midsole of FIG. 8B. Stiffening the medial ⅔ of the shoe's forefoot about the long axis appeared to keep a soft foam midsole flatter during lateral movements and reduced the "tube sock" effect (i.e. how much a shoe wraps around the foot).

Both midsoles were made of the same soft foam. The plated midsole shoe had the addition of a carbon fiber insert on the medial ⅔ of the forefoot. The carbon fiber forefoot insert was very stiff when bent about the long axis of the shoe (in the frontal plane), but was cut to reduce stiffness about the medial-lateral axis (in the sagittal plane). The plate extended ⅔ of the distance from the medial to lateral side to allow the foot to hold the plate down without increasing pressured under the 5th metatarsal.

As illustrated in FIGS. 8A and 8B, the plated midsole with the carbon fiber insert remained flatter relative to the ground during a "high-effort" shuttle cut than the control shoe. The medial forefoot portion of the control shoe lifted higher from the glass force platform during the shuttle cut, particularly during the large decelerations and accelerations of the body. The foot did not protrude as far over the lateral portion of the midsole in the control shoe, possibly due to the midsole deformation (i.e. the shoe wrapped around the foot more). With the carbon fiber insert, the upper appeared to have larger upper deformations and the foot slid further over the lateral side of the midsole. In addition, data collected during the shuttle cuts indicated that these athletes may have cut faster in the plated shoe than in the control while entering and exiting at comparable speeds.

Example 2

Figure 14:
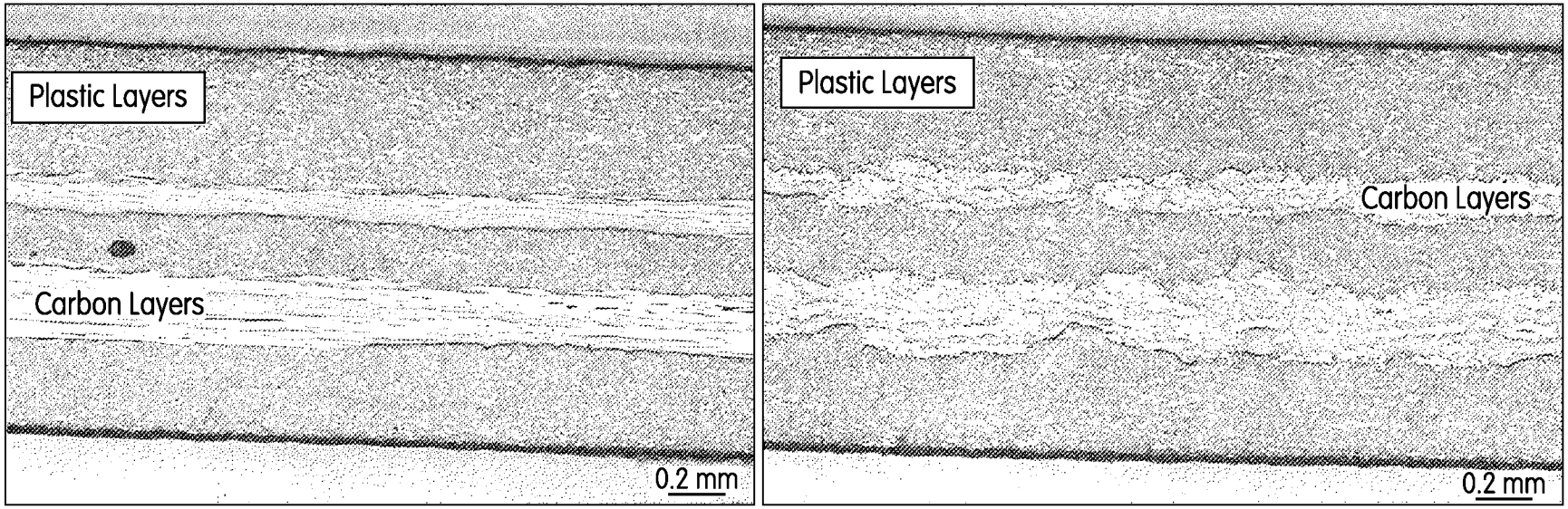
FIG. 14 depict layered structure of pressed 3-D printed inserts.
Figure 15A:
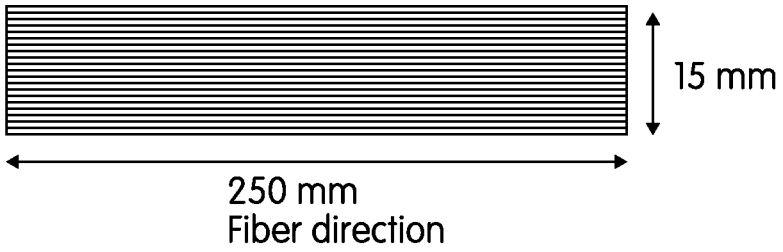
FIGS. 15A-15B depict tensile coupons and FIGS. 15C-D depict flex coupons.
Figure 15B:
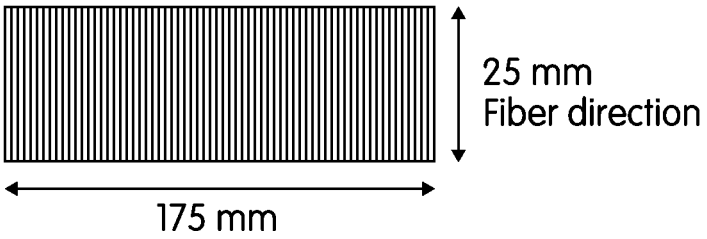
Figure 15C:
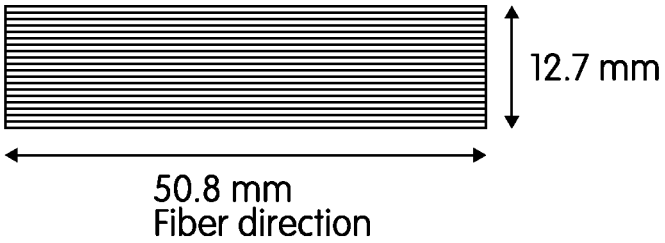
Figure 15D:
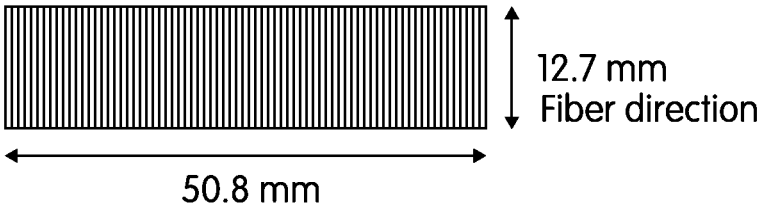
Figure 16A:
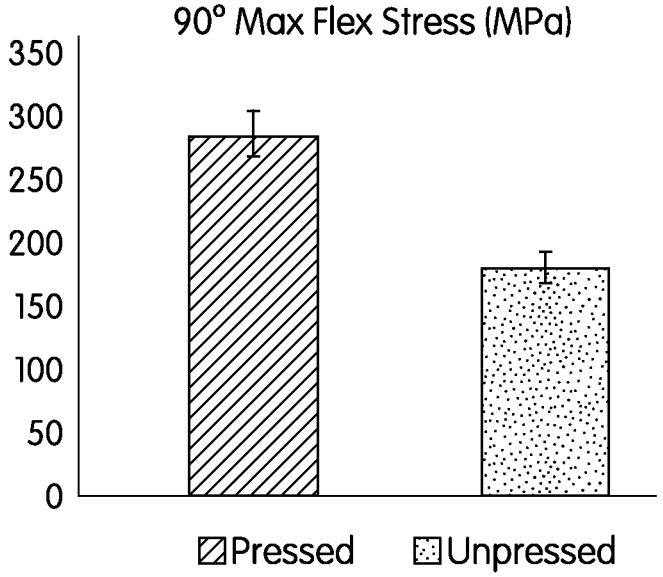
FIGS. 16A-16D depict flex results of pressed and unpressed coupons.
Figure 16B:
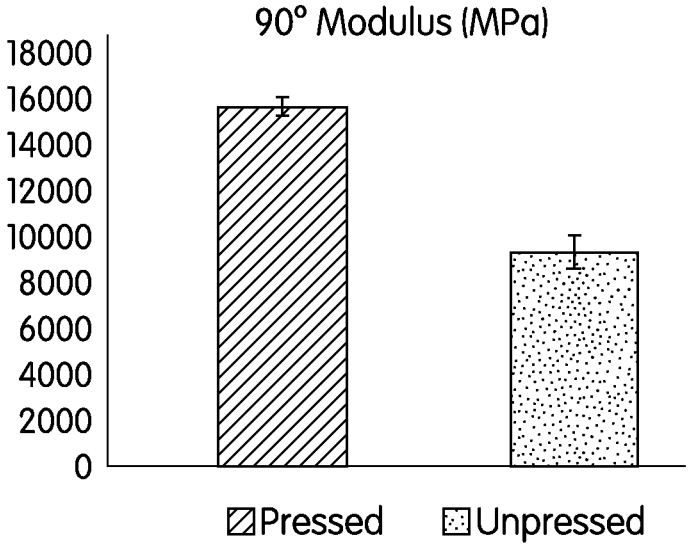
Figure 16C:
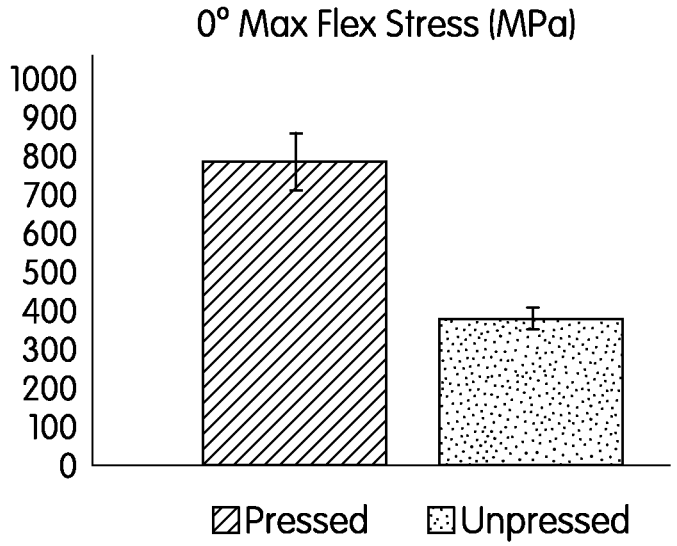
Figure 16D:
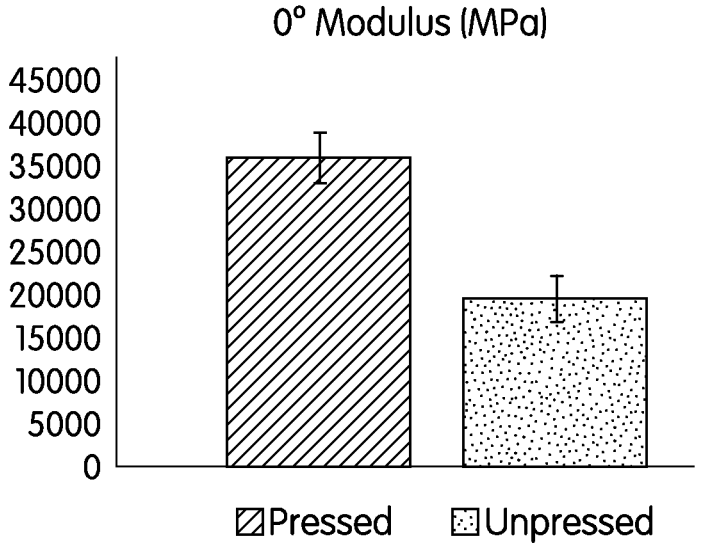

Flat 3D printed inserts containing plastic and carbon layers were made using a 3D printer 3D printing material. Carbon layers were sandwiched between the plastic layers. The inserts were then molded to form a 90° edge similar to FIG. 7A. Microscopy analysis was performed pre and post molding. Processing temperatures were select based on melt temperature of the plastic material (~180° C.). The quality of the carbon fiber layers improved upon post molding as can be seen in FIG. 14. Forming the insert at temperatures (210° C.) above the melt temperature (180° C.) greatly reduced the amount of porosity and voids present in the parts. The right figure shows the cut sample with fibers end on, and the left figure shows the length of the fibers.

Example 3

To quantify the impact of quality improvement, tensile and flex coupons were printed per ASTM D3039 and D790 respectively. The coupon layups are shown in the tables below and dimensions and fiber direction details are shown in FIGS. 15A-15D. Prior to testing, half the coupons were pressed at 210° C. and 2 tons of pressure.

Coupon 1: 0° Tensile Coupons—per ASTM D3039 type A. See FIG. 15A.

| 0° Tensile Coupons - Layup | | |
|---|---|---|
| Layer # | Material | Layer thickness (mm) |
| 16 | plastic | 0.127 |
| 15 | carbon | 0.127 |
| 14 | carbon | 0.127 |
| 13 | carbon | 0.127 |
| 12 | carbon | 0.127 |
| 11 | carbon | 0.127 |
| 10 | carbon | 0.127 |
| 9 | carbon | 0.127 |
| 8 | carbon | 0.127 |
| 7 | carbon | 0.127 |
| 6 | carbon | 0.127 |
| 5 | carbon | 0.127 |
| 4 | carbon | 0.127 |
| 3 | carbon | 0.127 |
| 2 | carbon | 0.127 |
| 1 | plastic | 0.127 |
| | total thickness | 2.032 |

Coupon 2: 90° Tensile Coupons—per ASTM D3039 type B. See FIG. 15B.

| 90° Tensile Coupons - Layup | | |
|---|---|---|
| Layer # | Material | Layer thickness (mm) |
| 8 | plastic | 0.127 |
| 7 | carbon | 0.127 |
| 6 | carbon | 0.127 |
| 5 | carbon | 0.127 |
| 4 | carbon | 0.127 |
| 3 | carbon | 0.127 |
| 2 | carbon | 0.127 |
| 1 | plastic | 0.127 |
| | total thickness | 1.016 |

Coupons 3 and 4: Dimensions of 0° and 90° Tensile Coupons—per ASTM D790 See FIG. 15C and FIG. 15D.

| 0° and 90° Flex Coupons - Layup | | |
|---|---|---|
| Layer # | Material | Layer thickness (mm) |
| 16 | plastic | 0.127 |
| 15 | carbon | 0.127 |
| 14 | carbon | 0.127 |
| 13 | carbon | 0.127 |
| 12 | carbon | 0.127 |
| 11 | carbon | 0.127 |
| 10 | carbon | 0.127 |
| 9 | carbon | 0.127 |
| 8 | carbon | 0.127 |
| 7 | carbon | 0.127 |
| 6 | carbon | 0.127 |
| 5 | carbon | 0.127 |
| 4 | carbon | 0.127 |
| 3 | carbon | 0.127 |
| 2 | carbon | 0.127 |
| 1 | plastic | 0.127 |
| | total thickness | 2.032 |

Flex Results per ASTM D790 are shown in FIGS. 16A-D. There was an approximately 200% increase in 0° flex properties when pressed and greater than 150% increase in 90° flex properties when pressed. The pressed coupons were thinner, so improvement in properties is likely due to improved quality and reduced cross-sectional area.

In one aspect, the present invention includes a sole structure for an article of footwear including:

a midsole having forefoot, midfoot, and heel regions, the midsole having a front edge in the forefoot region;

a support plate located on an underside of the midsole on a medial forefoot side of the midsole and extending from a medial edge of the midsole to at least a longitudinal center line of the midsole, wherein a lateral edge of the support plate is located medially of the lateral edge of the midsole;

wherein the support plate contains at least one sipe or groove extending laterally across the midsole to provide flexibility in a forefoot-to-heel direction of the midsole; and wherein the support plate is substantially incompressible;

wherein a front edge of the support plate is located rearward of the front edge of the midsole in a toe region; and a rear edge of the support plate is located forward of the midfoot region.

Further aspects may include, but are not limited to, one or more of the following: The support plate may contain at least two sipes or grooves extending laterally across the midsole to provide flexibility in a forefoot-to-heel direction of the midsole. The support plate may be positioned adjacent the medial edge of the midsole. The support plate may wrap around the medial edge and upward on an outside medial wall of the midsole. The support plate may be recessed into the midsole. The support plate may extend across at least sixty percent or at least seventy percent of a distance from the medial edge of the midsole toward the lateral edge of the midsole. The support plate further has a tapered edge located proximal to the lateral edge of the midsole. The support plate may have a thickness of less than 10 mm. The support plate may be adhered to the midsole.

In another aspect, the present invention includes a sole structure for an article of footwear including:

a midsole having forefoot, midfoot, and heel regions, the midsole having a front edge in the forefoot region;

at least two support plates located on an underside of the midsole on a medial forefoot side of the midsole and extending from a medial edge of the midsole to at least a longitudinal center line of the midsole, wherein a lateral edge of each plate is located medially of the lateral edge of the midsole;

wherein the at least two support plates are positioned such that adjacent sides extend laterally across the midsole to provide flexibility in a forefoot-to-heel direction of the midsole; and wherein the at least two support plates are substantially incompressible;

wherein a front edge of a first plate is located rearward of the front edge of the midsole in a toe region; and a rear edge of a second plate is located forward of the midfoot region.

Further aspects may include, but are not limited to, one or more of the following: The at least two support plates may have three support plates positioned such that adjacent sides extend laterally across the midsole to provide flexibility in a forefoot-to-heel direction of the midsole, wherein a third plate is positioned between the first plate and second plate. The at least two support plates may be positioned adjacent the medial edge of the midsole. At least one of the at least two support plates may wrap around the medial edge and upward on an outside medial wall of the midsole. At least two support plates may be recessed into the midsole. At least one of the at least two support plates may extend across at least sixty percent or at least seventy percent of a distance from the medial edge of the midsole toward the lateral edge of the midsole. At least one of the at least two support plates may further have a tapered edge located proximal to the lateral edge of the midsole. The at least two support plates may have a thickness of less than 10 mm. The at least two support plates may be adhered to the midsole.

In another aspect, the present invention includes a sole structure for an article of footwear including:

a midsole having forefoot, midfoot, and heel regions, the midsole having a front edge in the forefoot region;

at least one support plate having an upper surface and a lower surface and located on an underside of the midsole on a medial forefoot side of the midsole and a length of the support plate extending from a medial edge of the midsole to at least a longitudinal center line of the midsole, wherein a lateral edge of the support plate is located medially of the lateral edge of the midsole;

wherein the lower surface of the support comprises at least one rail having a length extending at least from a point at or near the medial edge of the support plate to the lateral edge of the support plate, wherein the at least one rail has a width narrower than a corresponding width of the support plate;

wherein the support plate is substantially incompressible;

wherein a front edge of the support plate is located rearward of the front edge of the midsole in a toe region; and a rear edge of the support plate is located forward of the midfoot region.

Further aspects may include, but are not limited to, one or more of the following: The lower surface of the at least one support plate includes at least two rails, each having a length extending at least from a point at or near the medial edge of the support plate to the lateral edge of the support plate, wherein each rail has a width narrower than a corresponding width of the support plate; the at least two rails having the same width or different widths and the same length or different lengths. The lower surface of the at least one support plate includes at least three rails, each having a length extending at least from a point at or near the medial edge of the support plate to the lateral edge of the support plate, wherein each rail has a width narrower than a corresponding width of the support plate; the at least three rails having the same width or different widths and the same length or different lengths, the rails spaced apart from each other evenly or unevenly.

The at least one plate may include at least first and second support plates located on an underside of the midsole on a medial forefoot side of the midsole and extending from a medial edge of the midsole to at least a longitudinal center line of the midsole, wherein a lateral edge of each plate is located medially of the lateral edge of the midsole; wherein the first and second support plates are positioned such that adjacent sides extend laterally across the midsole to provide flexibility in a forefoot-to-heel direction of the midsole. The first support plate may include at least a first rail extending from a point at or near the medial edge of the first support plate to the lateral edge of the first support plate, wherein the second support plate comprises at least a second rail extending from a point at or near the medial edge of the second support plate to the lateral edge of the second support plate. The first support plate may include at least two rails extending from a point at or near the medial edge of the first support plate to the lateral edge of the first support plate, the at least two rails having the same width or different widths and the same length or different lengths.

The at least one rail may wrap around the medial edge and upward on an outside medial wall of the midsole. The at least one support plate may be recessed into the midsole. The at least one support plate may extend across at least sixty percent or at least seventy percent of a distance from the medial edge of the midsole toward the lateral edge of the midsole. The at least one support plate may have a tapered edge located proximal to the lateral edge of the midsole.

The at least one support plate has a thickness of less than 10 mm. The at least one support plate may be adhered to the midsole. The at least one rail may be adhered to the support plate.

Any of the sole structures defined herein may have a ground-engaging outsole attached to a bottom of the midsole wherein the support plate(s) is/are between the midsole and the outsole. Any of the aspects may be part of an article of footwear having an upper forming an interior void; and a sole structure as defined herein attached to the upper.

The foregoing has been presented for purposes of illustration and description. The foregoing is not intended to be exhaustive or to limit embodiments to the precise forms described above, and modifications and variations are possible in light of the above teachings or may be acquired from practice of various embodiments. The examples discussed herein were chosen and described in order to explain the principles and the nature of various embodiments and their practical application to enable one skilled in the art to utilize the present disclosure in various embodiments and with various modifications as are suited to the particular use contemplated. Any and all combinations, subcombinations and permutations of features from herein-described embodiments are the within the scope of the disclosure. In the claims, a reference to a potential or intended wearer or a user of a component does not require actual wearing or using of the component or the presence of the wearer or user as part of the claim.

We claim:

1. A sole structure for an article of footwear comprising:

a midsole having forefoot, midfoot, and heel regions, the midsole having a front edge in the forefoot region;

a support plate located on an underside of the midsole on a medial forefoot side of the midsole and extending from a medial edge of the midsole to at least a longitudinal center line of the midsole, wherein a lateral edge of the support plate is located medially of the lateral edge of the midsole;

wherein the support plate contains at least one sipe or groove extending laterally across the midsole to provide flexibility in a forefoot-to-heel direction of the midsole; and wherein the support plate is substantially incompressible;

wherein a front edge of the support plate is located rearward of the front edge of the midsole in a toe region; and a rear edge of the support plate is located forward of the midfoot region.

2. The sole structure of claim 1, wherein the support plate contains at least two sipes or grooves extending laterally across the midsole to provide flexibility in a forefoot-to-heel direction of the midsole.

3. The sole structure of claim 1, wherein the support plate is positioned adjacent the medial edge of the midsole.

4. The sole structure of claim 1, wherein the support plate wraps around the medial edge and upward on an outside medial wall of the midsole.

5. The sole structure of claim 1, wherein the support plate is recessed into the midsole.

6. The sole structure of claim 1, wherein the support plate extends across at least sixty percent or at least seventy percent of a distance from the medial edge of the midsole toward the lateral edge of the midsole.

7. The sole structure of claim 1, wherein the support plate further has a tapered edge located proximal to the lateral edge of the midsole.

8. The sole structure of claim 1, wherein the support plate is adhered to the midsole.

9. The sole structure of claim 1 further comprising a ground-engaging outsole attached to a bottom of the midsole wherein the support plate is between the midsole and the outsole.

10. An article of footwear comprising an upper forming an interior void; and a sole structure as defined in claim 9 attached to the upper.

11. A sole structure for an article of footwear comprising:

a midsole having forefoot, midfoot, and heel regions, the midsole having a front edge in the forefoot region;

at least two support plates located on an underside of the midsole on a medial forefoot side of the midsole and extending from a medial edge of the midsole to at least a longitudinal center line of the midsole, wherein a lateral edge of each plate is located medially of the lateral edge of the midsole;

wherein the at least two support plates are positioned such that adjacent sides extend laterally across the midsole to provide flexibility in a forefoot-to-heel direction of the midsole; and wherein the at least two support plates are substantially incompressible;

wherein a front edge of a first plate is located rearward of the front edge of the midsole in a toe region; and a rear edge of a second plate is located forward of the midfoot region.

12. The sole structure of claim 11, wherein the at least two support plates comprise three support plates positioned such that adjacent sides extend laterally across the midsole to provide flexibility in a forefoot-to-heel direction of the midsole, wherein a third plate is positioned between the first plate and second plate.

13. The sole structure of claim 11, wherein the at least two support plates are positioned adjacent the medial edge of the midsole.

14. The sole structure of claim 11, wherein at least one of the at least two support plates wrap around the medial edge and upward on an outside medial wall of the midsole.

15. The sole structure of claim 11, wherein the at least two support plates are recessed into the midsole.

16. The sole structure of claim 11, wherein at least one of the at least two support plates extend across at least sixty percent or at least seventy percent of a distance from the medial edge of the midsole toward the lateral edge of the midsole.

17. The sole structure of claim 11, wherein at least one of the at least two support plates further has a tapered edge located proximal to the lateral edge of the midsole.

18. The sole structure of claim 11, wherein the at least two support plates are adhered to the midsole.

19. The sole structure of claim 11 further comprising a ground-engaging outsole attached to a bottom of the midsole wherein the support plates are between the midsole and the outsole.

20. An article of footwear comprising an upper forming an interior void; and a sole structure as defined in claim 19 attached to the upper.

* * * * *